US011150611B2

(12) United States Patent
Aoki et al.

(10) Patent No.: US 11,150,611 B2
(45) Date of Patent: Oct. 19, 2021

(54) WEARABLE DEVICE AND TIME CORRECTION METHOD

(71) Applicant: SEIKO EPSON CORPORATION, Tokyo (JP)

(72) Inventors: Mikio Aoki, Suwa (JP); Hiroshi Matsushita, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 276 days.

(21) Appl. No.: 16/434,212

(22) Filed: Jun. 7, 2019

(65) Prior Publication Data

US 2019/0377303 A1 Dec. 12, 2019

(30) Foreign Application Priority Data

Jun. 8, 2018 (JP) ..... JP2018-110316

(51) Int. Cl.
*G04G 21/02* (2010.01)
*G04G 9/00* (2006.01)

(52) U.S. Cl.
CPC ..... *G04G 21/02* (2013.01); *G04G 9/0076* (2013.01)

(58) Field of Classification Search
CPC ..... G04G 9/0076; G04G 21/02; G04G 9/02; G04G 21/00; G04G 5/00; G04C 3/146; G04C 9/08; G04R 20/26; G04R 20/02; G04B 47/066
USPC ..... 368/21
See application file for complete search history.

(56) References Cited

U.S. PATENT DOCUMENTS 5,500,835 A * 3/1996 Born ..... G04C 3/146 368/11
10,095,189 B2 * 10/2018 Masserot ..... G04C 3/146
2018/0004169 A1 * 1/2018 Matsuzaki ..... G06F 1/1658

FOREIGN PATENT DOCUMENTS

| | | | |
|---|---|---|---|
| JP | 2005-221449 | A | 8/2005 |
| JP | 2007-085878 | A | 4/2007 |
| JP | 2008-051529 | A | 3/2008 |
| JP | 2008-107312 | A | 5/2008 |
| JP | 2009-133784 | A | 6/2009 |

* cited by examiner

*Primary Examiner* — Edwin A. Leon
(74) *Attorney, Agent, or Firm* — Oliff PLC

(57) ABSTRACT

There is provided a wearable device including: a display that displays time; and a processor, in which the processor includes an acquisition unit that acquires moving object information related to a moving object which moves to a destination place and a time difference of the destination place with respect to standard time, and a correction unit that corrects the time to be displayed on the display unit based on the time difference when it is determined that a predetermined condition related to arrival of the moving object to the destination place is satisfied based on the moving object information.

7 Claims, 21 Drawing Sheets

T1

| NUMBER | CONTENT |
|---|---|
| 00 | ··· |
| 01 | GPS POSITION |
| 02 | ··· |
| ··· | ··· |
| 20 | CALL SIGN |
| ··· | ··· |
| 40 | SELECTED ALTITUDE |
| ··· | ··· |
| 255 | ··· |

505

| COUNTRY NAME OR REGION NAME | FREQUENCY BANDWIDTH |
|---|---|
| JAPAN | 920-925MHz |
| NORTH AMERICA | 902-928MHz |
| EUROPE | 867-869MHz |
| ... | ... |

FIG. 19

504

| | |
|---|---|
| GPS POSITION | LATITUDE: 35.77<br>LONGITUDE: 140.39 |
| CURRENT TIME | 2018/2/2 15:00 |
| ESTIMATED ARRIVAL TIME | 2018/2/3 4:00 |
| DELAY TIME | – |
| DESTINATION-PLACE NAME | NEW YORK XX AIRPORT |
| DESTINATION-PLACE TIME | 2018/2/2 1:00 |
| ALTITUDE | 0m |
| ... | ... |
| IN-FLIGHT SERVICE DATA | ENTERTAINMENT INFORMATION |

WEARABLE DEVICE AND TIME CORRECTION METHOD

The present application is based on, and claims priority from Japanese Application Serial Number 2018-110316, filed Jun. 8, 2018, the disclosure of which is hereby incorporated by reference herein in its entirety.

BACKGROUND

1. Technical Field

The present disclosure relates to a wearable device and a time correction method.

2. Related Art

A user who wears a wearable device that displays time may move across a time zone by a moving object such as an airplane. In this case, the wearable device needs to correct the time to be displayed by the wearable device to time of a destination place in accordance with arrival to the destination place. As a technique of correcting the time, for example, JP-A-2005-221449 discloses a wearable device including a global positioning system (GPS) module and an atmospheric pressure sensor. The wearable device determines whether an airplane descends and arrives at the destination place based on a change in atmospheric pressure measured by the atmospheric pressure sensor. When arrival to the destination place is detected, the wearable device acquires time of a current place from the GPS module, and corrects the time to be displayed by the wearable device based on the acquired time.

However, in general, the user moves in an indoor space such as an airport at the destination place, and in some cases, radio waves from GPS satellites may not be acquired in the indoor space. As a result, even when the user arrived at the destination place, in the wearable device of the related art, the time may not be immediately corrected.

SUMMARY

A wearable device according to a preferred aspect of the present disclosure includes: a display unit that displays time; and a processor, in which the processor includes an acquisition unit that acquires moving object information related to a moving object which moves to a destination place and a time difference of the destination place with respect to standard time, and a correction unit that corrects the time to be displayed on the display unit based on the time difference when it is determined that a predetermined condition related to arrival of the moving object to the destination place is satisfied based on the moving object information.

A time correction method according to another preferred aspect of the present disclosure is a time correction method of a wearable device including a display unit that displays time and a processor, the method causing the processor to: acquire moving object information related to a moving object which moves to a destination place and a time difference of the destination place with respect to standard time; and correct the time to be displayed on the display unit based on the time difference when it is determined that a predetermined condition related to arrival of the moving object to the destination place is satisfied based on the moving object information.

BRIEF DESCRIPTION OF THE DRAWINGS

FIG. 19 is a table illustrating an example of in-flight service information.

DESCRIPTION OF EXEMPLARY EMBODIMENTS

Hereinafter, embodiments of the present disclosure will be described with reference to the drawings. On the other hand, in each drawing, dimensions and scales of each unit are appropriately different from the actual ones. In addition, the embodiments to be described are preferable specific examples of the present disclosure. Thus, although technically-allowable various limitations are added, the scope of the present disclosure is not limited to the embodiments unless otherwise particularly stated in the following description to limit the present disclosure.

A. First Embodiment

Hereinafter, a wearable device W according to a first embodiment will be described.

A.1. Outline of Wearable Device W According to First Embodiment

Figure 1:
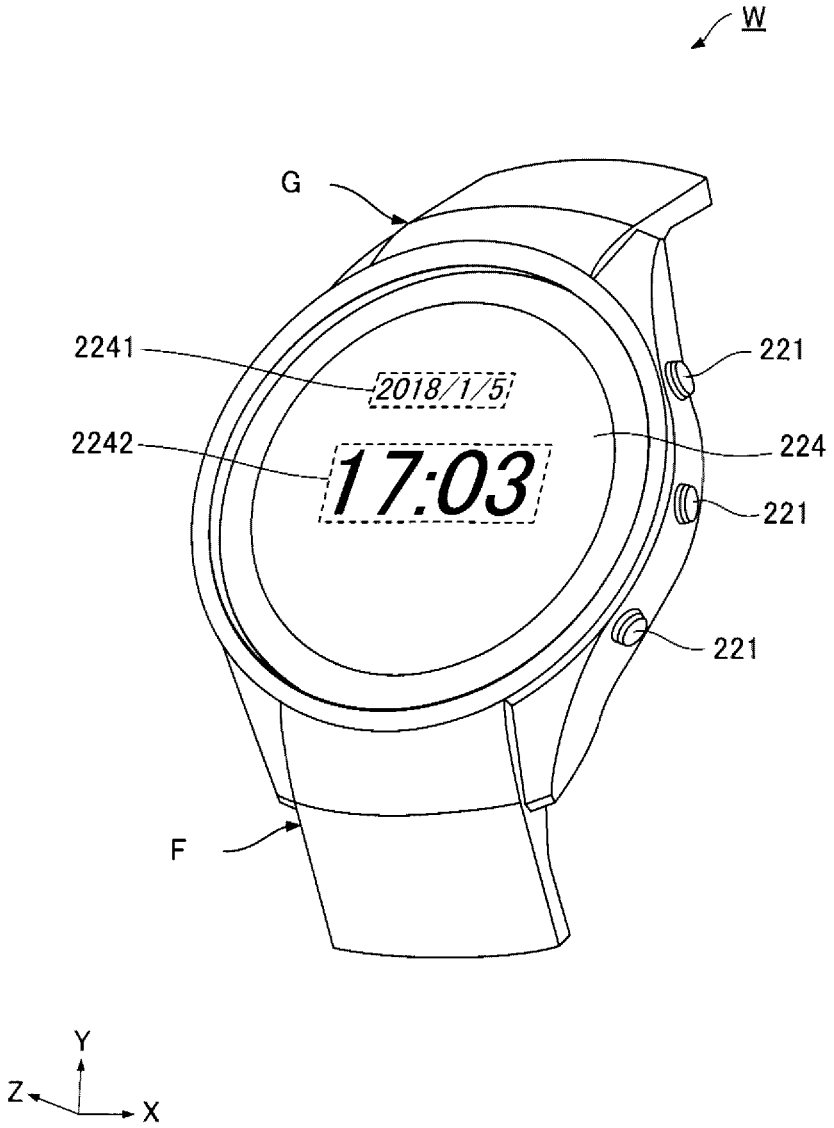
FIG. 1 is a perspective view illustrating a wearable device according to a first embodiment.

FIG. 1 is a perspective view illustrating a wearable device W according to a first embodiment. The wearable device W includes operation units 221, a first band unit F, a second band unit G, and a display unit 224. In general, the wearable device is a portable information device of a user. More specifically, the wearable device is an electronic device configured to be worn on a body of a user, and in the present embodiment, particularly, means an electronic device that includes a display unit displaying a date and time, a sensor measuring physical quantities, and a battery supplying power. As illustrated in FIG. 1, the wearable device W according to the first embodiment is a digital watch that displays time in a digital format. For the time, for example, there are the following two modes. The time in a first mode means time during a day, not including a year-month-day. The time in a second mode means time during a day, including a year-month-day at that time. Hereinafter, when simply referred to as "time", "time" indicates the time in the first mode, and when referred to as "date-and-time", "date-and-time" indicates time during a day including a year-month-day at that time. In addition, the time is hereinafter represented by using a 24-hour clock format.

In FIG. 1, it is assumed that a normal direction of a display surface of the display unit 224 is a Z axis, that a direction perpendicular to the Z axis and toward the first band unit F or the second band unit G from the center of the display surface is a Y axis, and that an axis perpendicular to the Z axis and the Y axis is an X axis.

When the user presses the operation unit 221, the operation unit 221 receives an operation of the user. The display unit 224 displays time and a year-month-day in a digital format. In FIG. 1, the display unit 224 displays a year-month-day of a current place in a display area 2241, and displays time of the current place in a display area 2242. The first band unit F and the second band unit G are members configured to allow the wearable device W to be worn on a wrist of the user.

Figure 2:
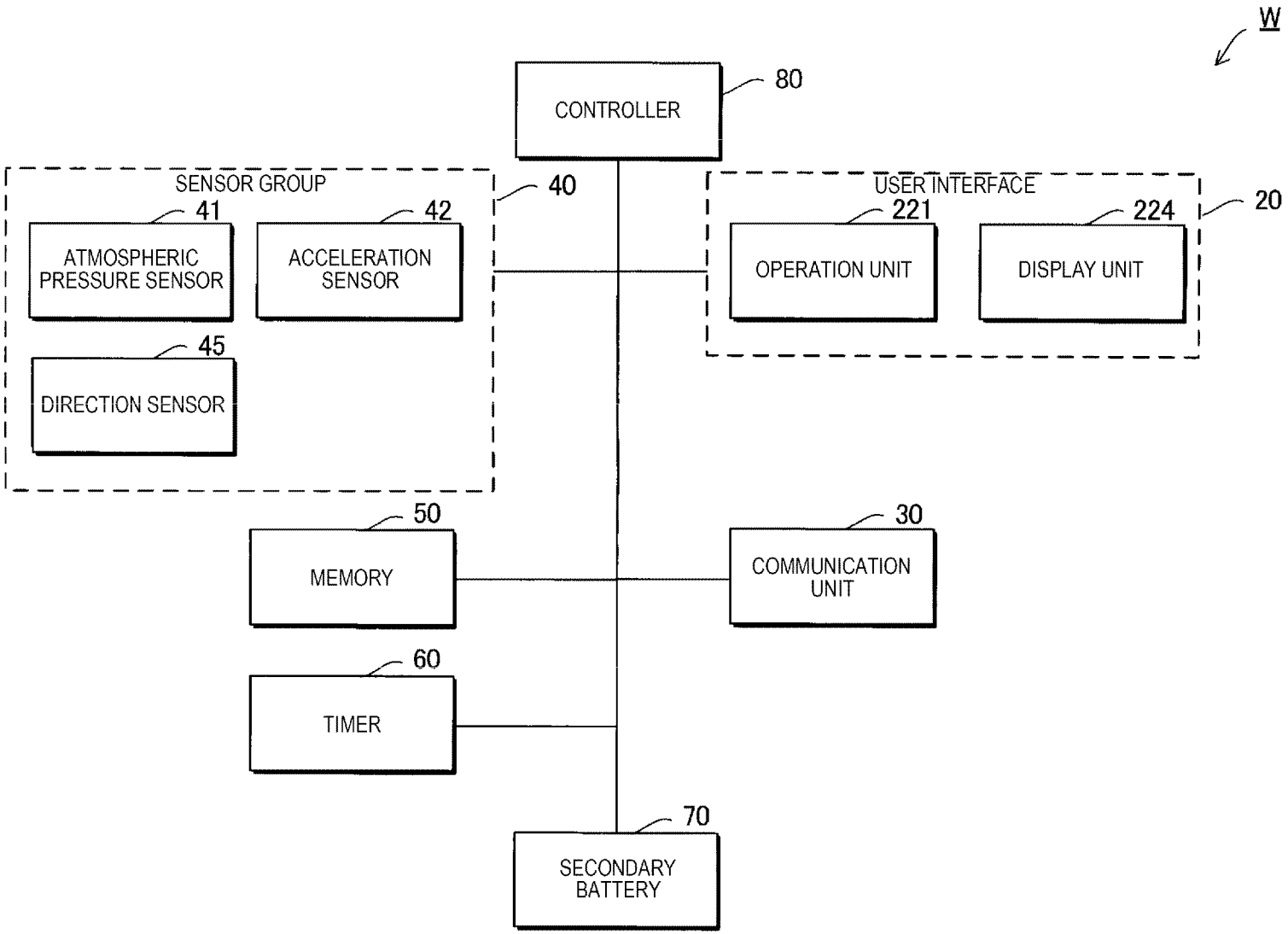
FIG. 2 is a configuration diagram of the wearable device according to the first embodiment.

FIG. 2 is a configuration diagram of the wearable device W. In FIG. 2, the same components as those illustrated in FIG. 1 are denoted by the same reference numerals.

The wearable device W includes a user interface 20, a communication unit 30, a sensor group 40, a memory 50, a timer 60, a secondary battery 70, and a controller 80, which are electrically coupled to each other via a bus.

The user interface 20 includes the operation unit 221 and the display unit 224. When the user presses the operation unit 221, the operation unit 221 receives an operation of the user. The operation unit 221 is, for example, a push button.

The display unit 224 displays the time. The display unit 224 is, for example, a liquid crystal display panel or an organic electro luminescence (EL) panel.

The communication unit 30 is a device that performs communication with another device via a network such as the Internet. The communication unit 30 performs communication with another device by wireless communication or wire communication. For example, the communication unit 30 includes, for example, a USB interface based on a Universal Serial Bus (USB) standard, a BLE interface based on a Bluetooth low energy (BLE) standard, or an ANT+ interface based on an ANT+ standard. Bluetooth is a registered trademark. In the USB interface, for example, the communication unit 30 performs communication with another device via a cable configured to be inserted into and removed from the wearable device W, or a cradle configured to allow insertion and removal of the wearable device W.

The sensor group 40 includes an atmospheric pressure sensor 41, an acceleration sensor 42, and a direction sensor 45. The atmospheric pressure sensor 41 measures atmospheric pressure around the wearable device W. The acceleration sensor 42 measures an acceleration speed applied to the wearable device W. The direction sensor 45 detects terrestrial magnetism on two axes or three axes, and measures a direction in which the wearable device W is toward.

The memory 50 is a recording medium configured to be read by the controller 80. The memory 50 is configured with, for example, a read only memory (ROM), an erasable programmable ROM (EPROM), an electrically erasable programmable ROM (EEPROM), a random access memory (RAM), or the like.

The timer 60 generates date-and-time information indicating the current date-and-time. Specifically, the timer 60 generates a date-and-time by counting pulse signals obtained by frequency-dividing a clock signal generated by a crystal oscillator or the like. The date-and-time indicates coordinated universal time (UTC).

The secondary battery 70 supplies power to the controller 80, the display unit 224, and the above components. The secondary battery 70 is, for example, a lithium ion secondary battery.

The controller 80 is a processor that controls the entire wearable device W, and is configured with, for example, one chip or a plurality of chips. The controller 80 is configured with, for example, a central processing unit (CPU) including an arithmetic device, a register, and the like. Some or all of functions of the controller 80 may be realized by a digital signal processor (DSP), an application specific integrated circuit (ASIC), a programmable logic device (PLD), a field programmable gate array (FPGA), or the like. The controller 80 executes various processing in parallel or sequentially. A configuration of the controller 80 will be described with reference to FIG. 3.

A.2. Controller 80 According to First Embodiment

Figure 3:
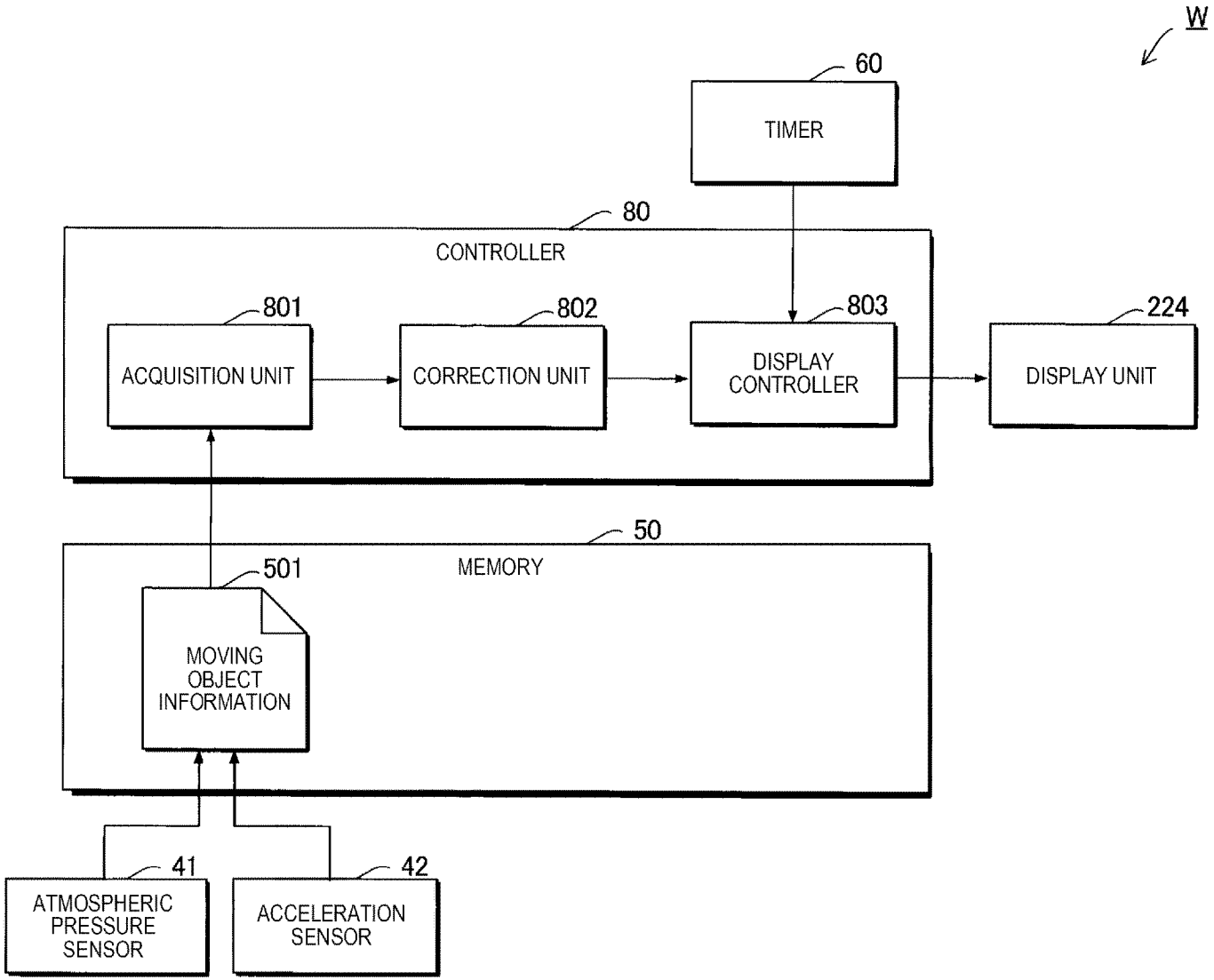
FIG. 3 is a configuration diagram of a controller according to the first embodiment.

FIG. 3 is a configuration diagram of the controller 80. The controller 80 functions as an acquisition unit 801, a correction unit 802, and a display controller 803 by reading and executing a program stored in the memory 50. A function of the controller 80 in a normal state and a function of the controller 80 when the user moves across a time zone will be respectively described.

A.2.1. Controller 80 in Normal State

In a normal state, the display controller 803 generates time to be displayed by the display unit 224 based on the date-and-time generated by the timer 60 and a time difference of the current place with respect to standard time. The standard time is time which is a standard for time display, and as a typical example, is the coordinated universal time which is used in the whole world. The standard time may be slower or faster than the coordinated universal time by a predetermined time. In the present embodiment, it is assumed that the standard time is the coordinated universal time. In addition, an example in which the display controller 803 generates time to be displayed by the display unit 224 based on the date-and-time generated by the timer 60 and a time difference of the current place with respect to the coordinated universal time, will be described. As an example of the time difference with respect to the coordinated universal time, a time differential factor (TDF) may be used.

In order to simplify descriptions, the time difference with respect to the coordinated universal time is hereinafter referred to as "time differential factor". In addition, the time to be displayed by the display unit 224 is simply referred to as "display time". Further, when the display time indicates local time of a departure place, the display time is referred to as "departure-place display time", and when the display time indicates local time of a destination place, the display time is referred to as "destination-place display time". In the present embodiment, the display time is displayed in the display area 2242. The time differential factor of the current place is stored in the memory 50. The time differential factor of the current place is set, for example, by an input operation of the user.

The display controller 803 generates, as the display time, time obtained by adding the time differential factor of the current place to the date-and-time generated by the timer 60. The display unit 224 displays time indicated by the display time.

A.2.2. Controller 80 when User Moves Across Time Zone

When the user is on a moving object, the user moves across a time zone. The moving object is an aircraft such as an airplane or a rotary wing aircraft, a ship, a train, or the like. In the present embodiment, it is assumed that the moving object is an airplane AP illustrated in FIG. 7. Hereinafter, an operation example of the acquisition unit 801 and an operation example of the correction unit 802 will be sequentially described.

A.2.2.1. Operation Example of Acquisition Unit 801

The acquisition unit 801 acquires moving object information 501, and a time difference of a destination place with respect to the coordinated universal time, that is, the time differential factor of the destination place. The moving object information 501 is information on the moving object which moves to the destination place. Therefore, the moving object information 501 is information on the airplane AP.

The moving object information 501 includes departure-place atmospheric pressure and current-place atmospheric pressure that are measured by the atmospheric pressure sensor 41, and an acceleration speed from a departure place to a current place that is measured by the acceleration sensor 42. The moving object information 501 is stored in the memory 50. For example, the controller 80 acquires departure-place atmospheric pressure measured by the atmospheric pressure sensor 41 and an acceleration speed measured by the acceleration sensor 42, and stores the atmospheric pressure and the acceleration speed in the memory 50. The controller 80 periodically acquires an acceleration speed measured by the acceleration sensor 42, and stores the acceleration speed in the memory 50. The acquisition unit 801 acquires the departure-place atmospheric pressure stored in the memory 50, the atmospheric pressure finally stored in the memory 50, and all the acceleration speeds stored in the memory 50, as the moving object information 501.

The acquisition unit 801 acquires the time differential factor of the destination place, for example, from an input operation by the user or from an external computer via the communication unit 30.

A.2.2.2. Operation Example of Correction Unit 802

The correction unit 802 determines whether or not a predetermined condition related to arrival of the airplane AP to the destination place is satisfied based on the moving object information 501. The predetermined condition related to arrival of the airplane AP to the destination place includes, for example, a condition for determining a state where the airplane AP will arrive soon at the destination place and a condition for determining a state where the airplane AP arrived at the destination place.

For example, when it is specified that the airplane AP is descending based on the acceleration speed of the moving object information 501, and when a ratio value between an altitude specified based on the atmospheric pressure of the moving object information 501 and an altitude specified based on the acceleration speed of the moving object information 501 is equal to or larger than a predetermined value A, the correction unit 802 determines that the predetermined condition is satisfied. When the airplane AP is descending and the ratio value is smaller than 1, the airplane AP does not yet arrive at the destination place, and thus the predetermined condition according to the first embodiment is the condition for determining a state where the airplane AP will arrive soon at the destination place. As a method of determining whether the airplane AP is descending based on the acceleration speed of the moving object information 501, a method of determining whether the airplane AP is descending based on a sign of a speed obtained by integrating the acceleration speeds of the moving object information 501 in a gravitational direction, may be used.

Hereinafter, the altitude specified based on the acceleration speed is referred to as "acceleration-speed altitude". Similarly, the altitude specified based on the atmospheric pressure is referred to as "atmospheric-pressure altitude". As a method of obtaining the acceleration-speed altitude, the correction unit 802 specifies the acceleration-speed altitude by integrating the acceleration speeds from the departure place to the current place in the gravitational direction twice, the acceleration speeds being included in the moving object information 501. The acceleration-speed altitude indicates a current altitude when a departure-place altitude is set as a reference. Similarly, the correction unit 802 specifies the atmospheric-pressure altitude by applying a general altitude conversion expression for converting atmospheric pressure to an altitude, to the current-place atmospheric pressure included in the moving object information 501. The atmospheric-pressure altitude also indicates an altitude when the departure-place altitude is set as a reference, and thus the atmospheric-pressure altitude may be matched with the acceleration-speed altitude.

When the departure-place altitude is set as a reference, the departure-place altitude may be set to 0 m. On the other hand, in order to avoid that the acceleration-speed altitude as a denominator in (1) to be described later becomes 0 m, preferably, the departure-place altitude is set to an arbitrary value other than 0 m. In the present embodiment, the departure-place altitude is set to an altitude specified by the departure-place atmospheric pressure. For example, it is assumed that an altitude obtained by applying the altitude conversion expression to the departure-place atmospheric pressure is 10 m. In addition, when an altitude obtained by applying the altitude conversion expression to the current-place atmospheric pressure is 100 m, the atmospheric-pressure altitude is assumed to be 100 m as it is. When an altitude obtained by integrating the acceleration speeds from the departure place to the current place twice is 90 m, the acceleration-speed altitude is set to 100 m obtained by adding the altitude of 90 m to an altitude of 10 m obtained by applying the altitude conversion expression to the departure-place atmospheric pressure.

In the departure place, the acceleration-speed altitude and the atmospheric-pressure altitude have the same value. The case where the ratio value between the atmospheric-pressure altitude and the acceleration-speed altitude is equal to or larger than the predetermined value A corresponds to a case where the following expression (1) is satisfied.

$$\text{atmospheric-pressure altitude/acceleration-speed altitude} \geq A \quad (1)$$

The predetermined value A is a value set by an engineer or a user of the wearable device W. The predetermined value A is a value larger than 0 and equal to or smaller than 1, and may be a value close to 1. Hereinafter, atmospheric-pressure altitude/acceleration-speed altitude is referred to as a correction value C. Based on expression (1) and the definition of the correction value C, a relationship of expression (2) is satisfied.

$$\text{atmospheric-pressure altitude} = C \times \text{acceleration-speed altitude} \quad (2)$$

Figure 4:
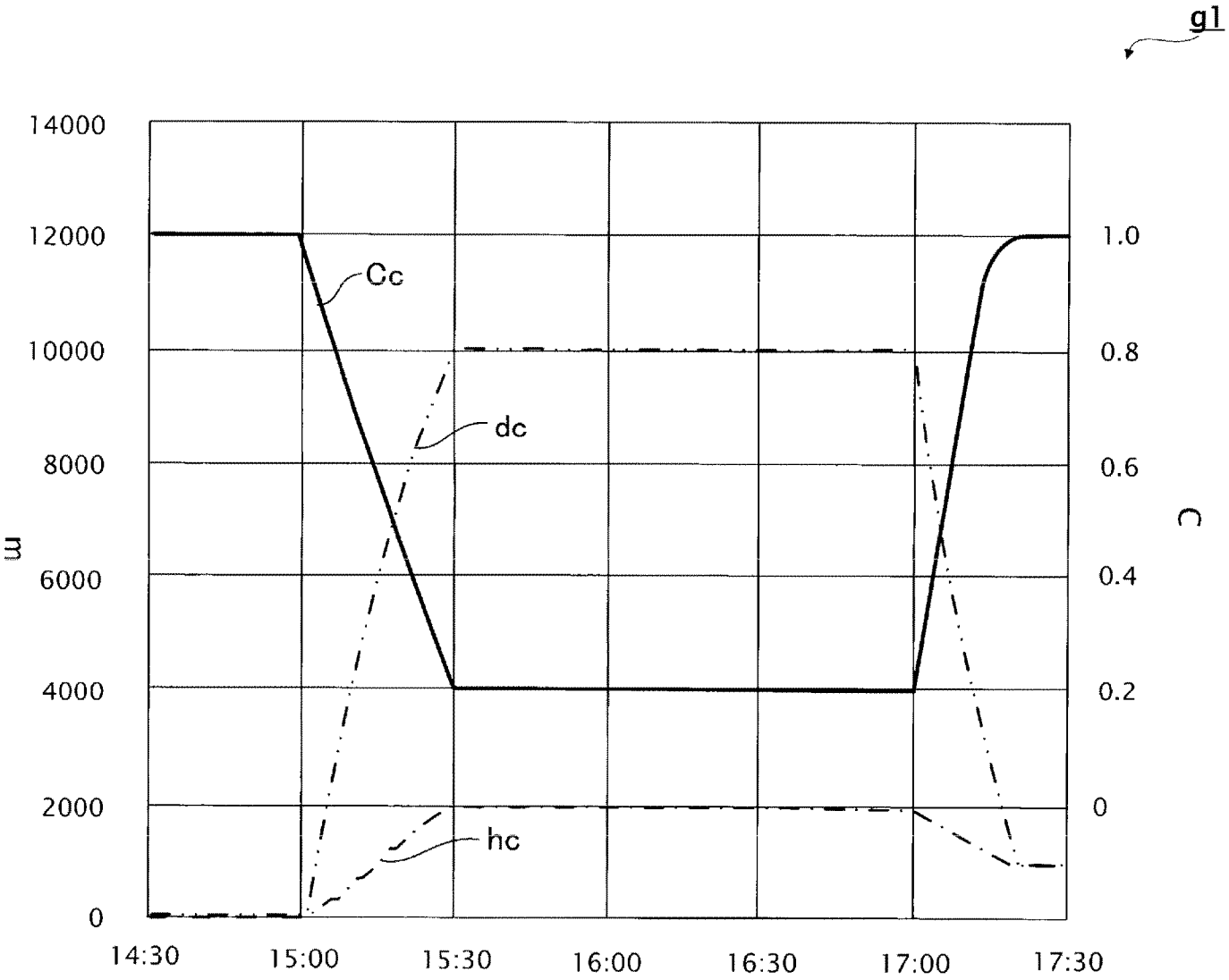
FIG. 4 is a graph illustrating a relationship between an atmospheric-pressure altitude and an acceleration-speed altitude.

FIG. 4 is a graph illustrating a relationship between the atmospheric-pressure altitude and the acceleration-speed altitude. The graph g1 illustrated in FIG. 4 illustrates a relationship between the atmospheric-pressure altitude and the acceleration-speed altitude in one flight of the airplane AP. It is assumed that the destination-place altitude illustrated in FIG. 4 is higher than the departure-place altitude by approximately 1,000 m. In order to simplify descriptions, the graph g1 illustrates an example in which the airplane AP ascends and descends at a constant speed and the altitude is not changed during a horizontal flight. In the graph g1, an atmospheric-pressure altitude characteristic hc indicated by a one-dotted line is a characteristic of the atmospheric-pressure altitude according to the flight of the airplane AP. In the graph g1, an acceleration-speed altitude characteristic dc indicated by a two-dotted line is a characteristic of the acceleration-speed altitude according to the flight of the airplane AP. In the graph g1, a correction value characteristic Cc indicated by a solid line is a characteristic of the correction value C according to the flight of the airplane AP.

The graph g1 illustrates an example in which the user boards the airplane AP at 14:30, the airplane AP takes off at 15:00, the airplane AP lands at 17:20, and the user gets off the airplane AP at 17:30.

In a period from 14:30 to 15:00, the atmospheric-pressure altitude and the acceleration-speed altitude almost match with each other. In a period after 15:00, the airplane AP rapidly increases the altitude, and both of the atmospheric-pressure altitude and the acceleration-speed altitude increase. On the other hand, as illustrated in the graph g1, a degree of an increase in the atmospheric-pressure altitude is smaller than a degree of an increase in the acceleration-speed altitude. The reason is as follows. In order to suppress an influence on persons in the airplane AP, atmospheric pressure in the airplane AP is controlled not to be sharply changed and not to be lower than atmospheric pressure corresponding to 2400 m. As a result, the degree of an increase in the atmospheric-pressure altitude becomes smaller than the degree of an increase in the acceleration-speed altitude.

As illustrated in the graph g1, the airplane AP ends the ascending at 15:30 and proceeds to a horizontal flight. Further, the airplane AP starts descending at 17:00, and ends the descending at 17:20 for landing.

A variation in the correction value C will be described. In a period from 14:30 to 15:00, since the airplane AP does not take off, the atmospheric-pressure altitude and the acceleration-speed altitude match with each other, and the correction value C is set to 1. In a period from 15:00 to 15:30, the airplane AP ascends, and both of the atmospheric-pressure altitude and the acceleration-speed altitude increase. At this time, the degree of an increase in the atmospheric-pressure altitude is smaller than the degree of an increase in the acceleration-speed altitude. Thus, the correction value C is set to a value smaller than 1, and at 15:30, the correction value C is set to 0.2.

In a period from 15:30 to 17:00, the airplane AP is in a horizontal flight, and the correction value C remains at 0.2. In a period from 17:00 and 17:20, the airplane AP descends and the correction value C increases to be close to 1, and the correction value C becomes 1 at 17:20. A condition in which the airplane AP descends and the correction value C becomes 1 means a state where an adjustment of atmospheric pressure in the airplane AP is completed and preparation for boarding and deplaning of passengers in the airplane AP is completed. Therefore, in the present embodiment, it is possible to determine whether the airplane AP arrives at the destination place using the correction value C.

The reason why the correction value C is used is as follows. When it is attempted to determine arrival of the airplane AP using only the atmospheric pressure sensor 41, there is a case where the atmospheric pressure in the airplane AP is controlled, and as a result, it is difficult to accurately determine whether the airplane AP arrives at the destination place. In addition, when it is attempted to determine arrival of the airplane AP by using only the acceleration sensor 42, in a case where an altitude difference between the departure place and the destination place is not known in advance, it is difficult to set an appropriate threshold value for determining whether the airplane AP arrives at the destination place.

Returning to the description of FIG. 3, when it is determined that the predetermined condition is satisfied, the correction unit 802 determines that the display time is to be corrected, and corrects the display time based on the time differential factor of the destination place. The correction unit 802 calculates a year-month-day and time of the destination place according to the following expression (3).

$$\text{year-month-day and time of destination place} = \text{current year-month-day and time} - \text{time differential factor of departure place} + \text{time differential factor of destination place} \quad (3)$$

The time differential factor of the departure place is stored in advance in the memory 50, as the time differential factor of the current place, for example, by an input operation of the user when the user is in the departure place. The current year-month-day and time is a value obtained by adding the time differential factor of the departure place to the date-and-time generated by the timer 60. Therefore, expression (3) may be modified as expression (4) by using the date-and-time generated by the timer 60.

$$\text{year-month-day and time of destination place} = \text{date-and-time generated by timer 60} + \text{time differential factor of destination place} \quad (4)$$

For example, it is assumed that the current year-month-day and time is 15:00 on Jan. 5, 2018, that the time differential factor of the departure place with respect to the standard time is +9:00, and that the time differential factor of the destination place with respect to the standard time is −5:00. The correction unit 802 calculates that the year-month-day and time of the destination place is 1:00 on Jan. 5, 2018 according to expression (3).

The correction unit 802 corrects the time calculated according to expression (3), as the destination-place display time. The display unit 224 displays the destination-place display time.

A.3. Operation According to First Embodiment

An operation of the wearable device W when the user moves across a time zone will be described with reference to a flowchart illustrated in FIG. 5.

Figure 5:
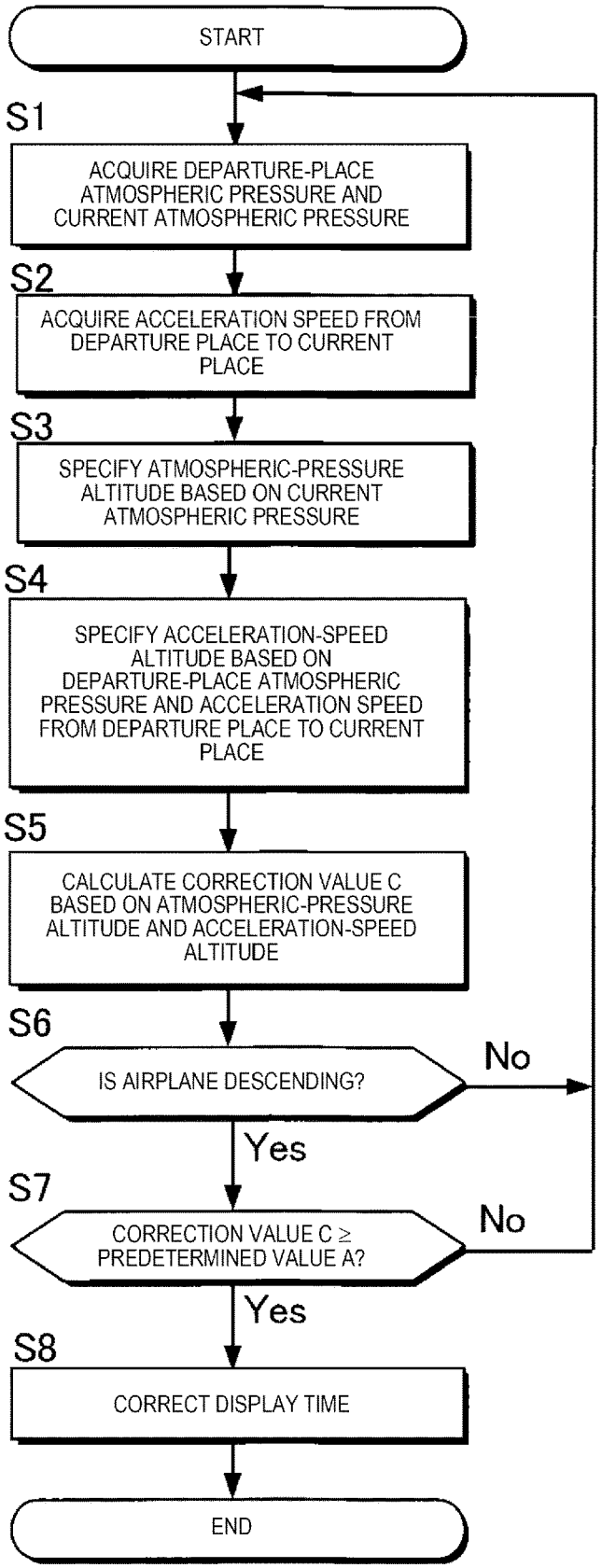
FIG. 5 is a flowchart illustrating an operation of the wearable device according to the first embodiment.

FIG. 5 is a flowchart illustrating an operation of the wearable device W. In step S1, the acquisition unit 801 acquires the departure-place atmospheric pressure and the current-place atmospheric pressure included in the moving object information 501. In step S2, the acquisition unit 801 acquires the acceleration speed from the departure place to the current place. In step S3, the correction unit 802 specifies the atmospheric-pressure altitude based on the current-place atmospheric pressure. In step S4, the correction unit 802 specifies the acceleration-speed altitude based on the departure-place atmospheric pressure and the acceleration speed from the departure place to the current place. In step S5, the correction unit 802 calculates the correction value C based on the atmospheric-pressure altitude and the acceleration-speed altitude.

In step S6, the correction unit 802 determines whether or not the airplane AP is descending. When a result of the determination in step S6 is No, that is, when the airplane AP is ascending or in a horizontal flight, the process returns to step S1. On the other hand, when the result of the determination in step S6 is Yes, that is, when the airplane AP is descending, in step S7, the correction unit 802 determines whether or not the correction value C is equal to or larger than the predetermined value A. When a result of the determination in step S7 is No, that is, when the correction value C is smaller than the predetermined value A, the correction unit 802 returns to the processing of step S1. On the other hand, when the result of the determination in step S7 is Yes, that is, when the correction value C is equal to or larger than the predetermined value A, in step S8, the correction unit 802 corrects the display time to the destination-place time based on the time differential factor of the destination place. After the processing of step S8 is ended, the wearable device W ends a series of processing.

A.4. Effects According to First Embodiment

As described above, in an aspect, the wearable device W includes a display unit 224 displaying time and a processor including an acquisition unit 801 and a correction unit 802. The acquisition unit 801 acquires moving object information 501 related to a moving object which moves to a destination place and a time difference of the destination place with respect to standard time. The correction unit 802 corrects the time to be displayed on the display unit 224 based on the time difference when it is determined that a predetermined condition related to arrival of the moving object to the destination place is satisfied based on the moving object information 501.

According to the aspect, when the predetermined condition related to arrival of the moving object to the destination place is satisfied, the display time is corrected. Thus, it is possible to correct the display time at an appropriate timing at which the arrival of the moving object to the destination place is considered.

On the other hand, even when it is attempted to correct the time using radio waves from GPS satellites, in general, the user moves in an indoor space at the destination place such as an airport, and in some cases, the radio waves from GPS satellites may not be acquired. As a result, even when the moving object arrived at the destination place, in the wearable device W, the time may not be immediately corrected. For this reason, it is ideal to determine whether the moving object approaches the destination place and to correct the time. On the other hand, a frequent use of the radio waves from GPS satellites causes an increase in power consumption.

Further, according to the wearable device W, the following time correction method may be realized. In the time correction method, the wearable device W, which includes a display unit 224 displaying time, acquires moving object information 501 related to a moving object which moves to a destination place and a time difference of the destination place with respect to standard time, and corrects the time to be displayed on the display unit 224 based on the time difference when it is determined that a predetermined condition related to arrival of the moving object to the destination place is satisfied based on the moving object information 501.

Further, in another aspect, the wearable device W includes an atmospheric pressure sensor 41 and an acceleration sensor 42. The moving object information 501 includes departure-place atmospheric pressure and current-place atmospheric pressure measured by the atmospheric pressure sensor 41, and an acceleration speed from the departure place to the current place measured by the acceleration sensor 42. The correction unit 802 specifies that the moving object is descending based on the acceleration speed of the moving object information 501, and determines that the predetermined condition is satisfied when a ratio value between an altitude specified based on the atmospheric pressure of the moving object information 501 and an altitude specified based on the acceleration speed of the moving object information 501 is equal to or larger than the predetermined value A.

As described above, a condition in which a correction value C becomes 1 means a state where an adjustment of atmospheric pressure in the airplane AP is completed and preparation for boarding and deplaning of passengers in the airplane AP is completed. According to the aspect, it is possible to correct the display time at an appropriate timing at which preparation for boarding and deplaning of passengers in the airplane AP is completed and the airplane AP will arrive soon.

On the other hand, when it is attempted to determine arrival of the airplane AP using only the atmospheric pressure sensor 41, there is a case where the atmospheric pressure in the airplane AP is controlled, and as a result, it is difficult to accurately determine whether the airplane AP arrives at the destination place. In addition, as described above, by integrating the acceleration speeds obtained from the acceleration sensor 42 twice, it is possible to calculate a current altitude when a departure-place altitude is set as a reference. On the other hand, it is necessary to recognize an altitude difference between the departure place and the destination place in advance. In this regard, according to the present embodiment, the arrival of the airplane AP is determined based on the ratio value between the altitude specified based on the atmospheric pressure and the altitude specified based on the acceleration speed. Thus, it is possible to determine the arrival of the airplane AP at the destination place with high accuracy even when the altitude difference between the departure place and the destination place is unknown.

B. Second Embodiment

In the first embodiment, the timing of correcting the display time is a timing when the airplane AP is descending and the correction value C is equal to or larger than the predetermined value A. In a second embodiment, the timing of correcting the display time is set to a timing when a frequency of a carrier wave of a first specific signal received by the wearable device W is included within a frequency bandwidth obtained by a frequency of a carrier wave of a first specific signal transmitted from the destination place. Hereinafter, the second embodiment will be described. In each of embodiments and modification examples to be described, components having the same effects and functions as those in the first embodiment are denoted by the same reference numerals used in the first embodiment, and detailed descriptions thereof will be appropriately omitted.

B.1. Outline of Wearable Device W According to Second Embodiment

Figure 6:
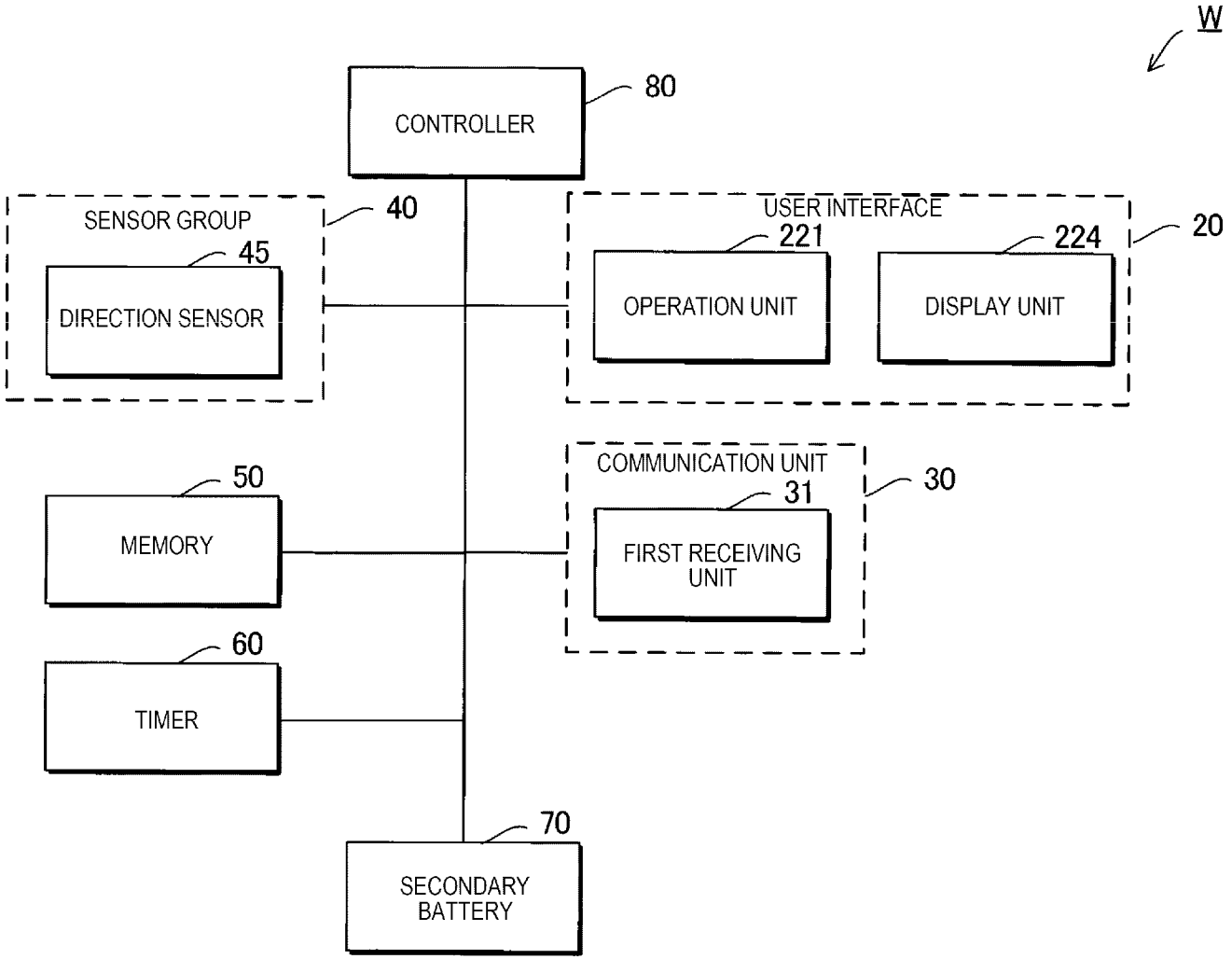
FIG. 6 is a configuration diagram of the wearable device according to a second embodiment.

FIG. 6 is a configuration diagram of the wearable device W according to a second embodiment. In order to simplify descriptions, it is assumed that the following components correspond to components according to the second embodiment unless otherwise stated. The communication unit 30 includes a first receiving unit 31.

The first receiving unit 31 is configured to receive a first specific signal transmitted from the moving object. The first specific signal is, for example, a signal based on an aerial radio standard called as automatic dependent surveillance-broadcast (ADS-B). The signal is hereinafter referred to as "aerial radio signal", and is described as an example of the first specific signal.

Figures 7, 8:
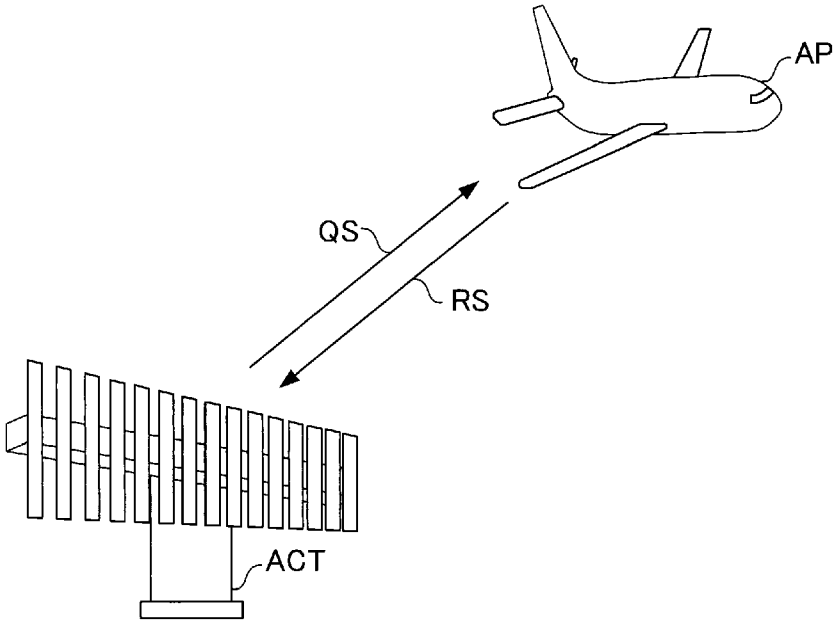
FIG. 7 is a diagram illustrating an example of communication of an aerial radio signal.
FIG. 8 is a table illustrating an example of a format of a response signal.

FIG. 7 illustrates an example of communication of the aerial radio signal. The airplane AP performs communication with a control tower ACT using the aerial radio signal so as to ensure safety of operation. The aerial radio signal includes a query signal QS and a response signal RS. The control tower ACT transmits a query signal QS to the airplane AP by a carrier wave of 1,030 MHz. When the query signal QS is received, the airplane AP transmits a response signal RS to the control tower ACT by a carrier wave of 1,090 MHz.

FIG. 8 is a table illustrating an example of a format of the response signal RS. In a response signal table T1 illustrated in FIG. 8, a list of information obtained by the response signal RS, is illustrated. The response signal RS includes a number and data content. For example, in the response signal table T1 illustrated in FIG. 8, the response signal RS with a number 01 includes a GPS position, the response signal RS with a number 20 includes a call sign, and the response signal RS with a number 40 includes a selected altitude of the airplane AP.

The GPS position indicates a current position of the airplane AP specified by a GPS module of the airplane AP. The call sign is a character string based on an abbreviation of an airline company and a flight number. The selected altitude is a selected altitude of the airplane AP.

Although not illustrated in the response signal table T1 illustrated in FIG. 8, the response signal RS may also include various data necessary for the operation management such as a relative speed and a flight code other than the GPS position, the call sign, and the selected altitude.

B.2. Controller 80 According to Second Embodiment

Figure 9:
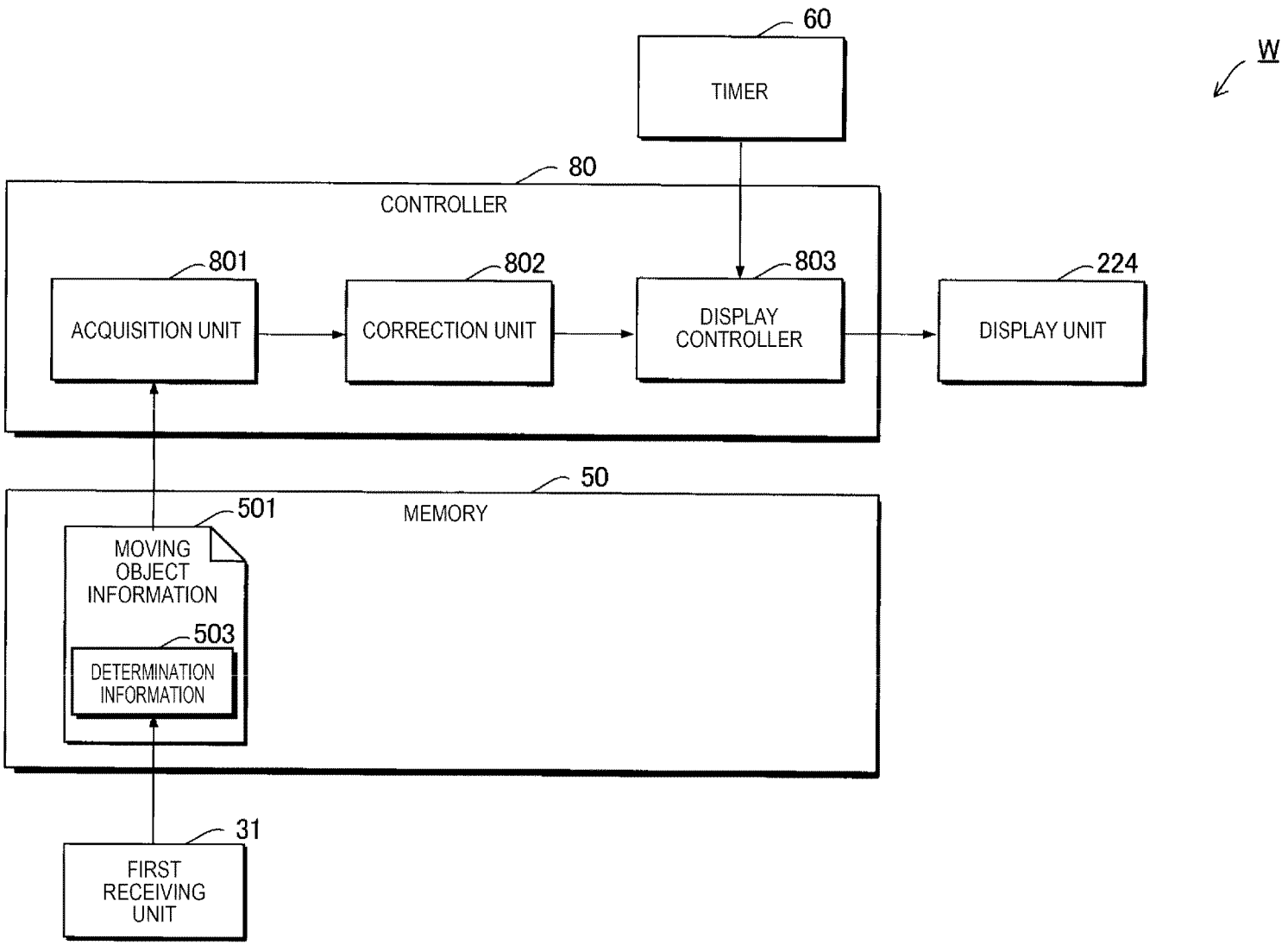
FIG. 9 is a configuration diagram of the controller according to the second embodiment.

FIG. 9 is a configuration diagram of the controller 80. The controller 80 functions as the acquisition unit 801, the correction unit 802, and the display controller 803 by reading and executing a program stored in the memory 50. The functions of the controller 80 in a normal state are the same as those in the first embodiment, and thus descriptions thereof will be omitted.

B.2.1. Controller 80 when User Moves Across Time Zone

The first receiving unit 31 generates determination information 503. The determination information 503 indicates whether or not the airplane AP is transmitting an aerial radio signal. The determination information 503 is included in the moving object information 501.

The correction unit 802 determines that a predetermined condition is satisfied when the determination information 503 included in the moving object information 501 indicates that the airplane AP does not transmit an aerial radio signal. The airplane AP transmits an aerial radio signal during flight, and does not transmit an aerial radio signal on arrival. Thus, the predetermined condition according to the second embodiment is a condition for determining whether the airplane AP arrived at the destination place.

B.3. Operation According to Second Embodiment

An operation of the wearable device W when the user moves across a time zone will be described with reference to a flowchart illustrated in FIG. 10.

Figure 10:
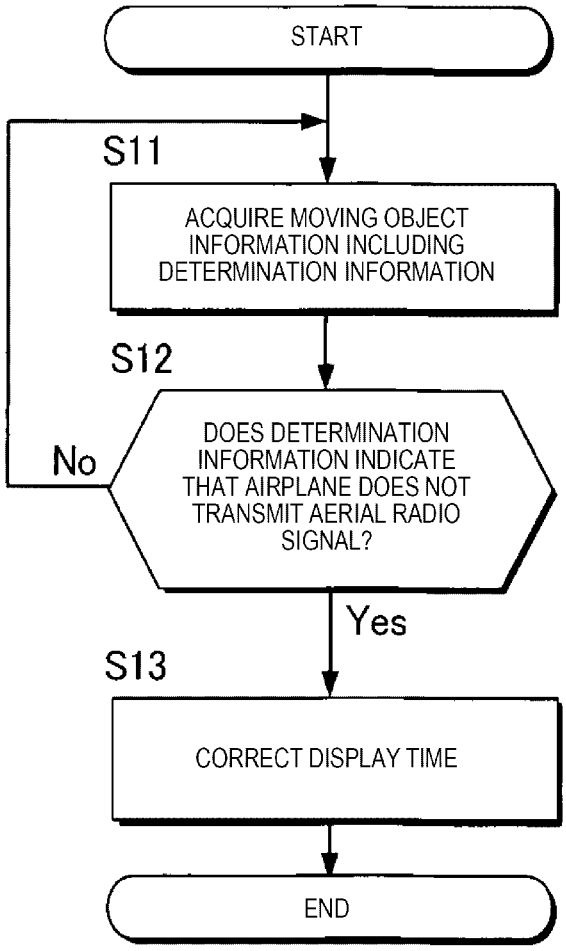
FIG. 10 is a flowchart illustrating an operation of the wearable device according to the second embodiment.

FIG. 10 is a flowchart illustrating an operation of the wearable device W. In step S11, the acquisition unit 801 acquires the moving object information 501 including the determination information 503. In step S12, the correction unit 802 determines whether or not the determination information 503 indicates that the airplane AP does not transmit an aerial radio signal. When a result of the determination in step S12 is No, that is, when the determination information 503 indicates that the airplane AP is transmitting an aerial radio signal, the correction unit 802 returns to the processing of step S11. On the other hand, when the result of the determination in step S12 is Yes, that is, when the determination information 503 indicates that the airplane AP does not transmit an aerial radio signal, in step S13, the correction unit 802 corrects the display time to the destination-place time based on the time differential factor of the destination place. After the processing of step S13 is ended, the wearable device W ends a series of processing.

B.4. Effects According to Second Embodiment

As described above, in still another aspect, the wearable device W includes a first receiving unit 31 configured to receive a first specific signal transmitted from a moving object. The first receiving unit 31 generates determination information 503 indicating whether or not the moving object is transmitting the first specific signal, and the determination information 503 is included in moving object information 501. The correction unit 802 determines that the predetermined condition is satisfied when the determination information 503 included in the moving object information 501 indicates that the moving object does not transmit the first specific signal.

A case where the moving object does not transmit an aerial radio signal means a state where the airplane AP arrived at the destination place. Therefore, according to the aspect, it is possible to correct the display time at an appropriate timing at which the airplane AP arrived at the destination place.

C. Third Embodiment

In a third embodiment, the timing of correcting the display time is set to a timing when a frequency of a carrier wave of a second specific signal received by the wearable device W is included within a frequency bandwidth obtained by a frequency of a carrier wave of a second specific signal transmitted from the destination place. Hereinafter, the third embodiment will be described. In each of embodiments and modification examples to be described, components having the same effects and functions as those in the first embodiment are denoted by the same reference numerals used in the first embodiment, and detailed descriptions thereof will be appropriately omitted.

C.1. Outline of Wearable Device W According to Third Embodiment

Figure 11:
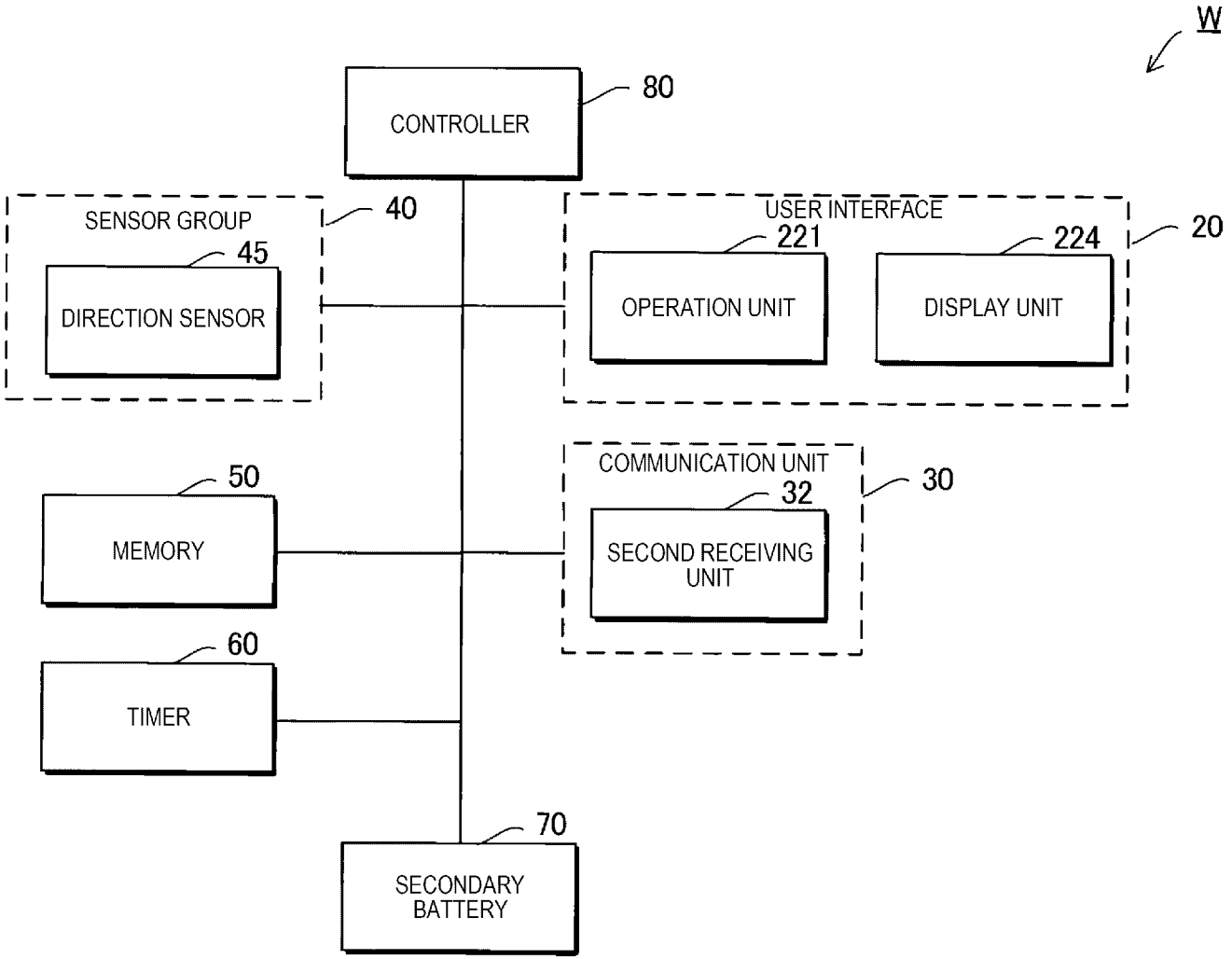
FIG. 11 is a configuration diagram of the wearable device according to a third embodiment.

FIG. 11 is a configuration diagram of the wearable device W according to a third embodiment. In order to simplify descriptions, it is assumed that the following components correspond to components according to the third embodiment unless otherwise stated. The communication unit 30 includes a second receiving unit 32.

The second receiving unit 32 is configured to receive a second specific signal whose frequency bandwidth obtained by a frequency of a carrier wave is different for each region. The second specific signal is, for example, a signal based on SIGFOX, LoRaWAN, or the like which is one of low power wide area (LPWA). SIGFOX is a registered trademark. SIGFOX, LoRaWAN, or the like uses a frequency bandwidth called as a sub-GHz bandwidth. The sub-GHz bandwidth is a frequency bandwidth that is different for each region.

C.2. Controller 80 According to Third Embodiment

Figure 12:
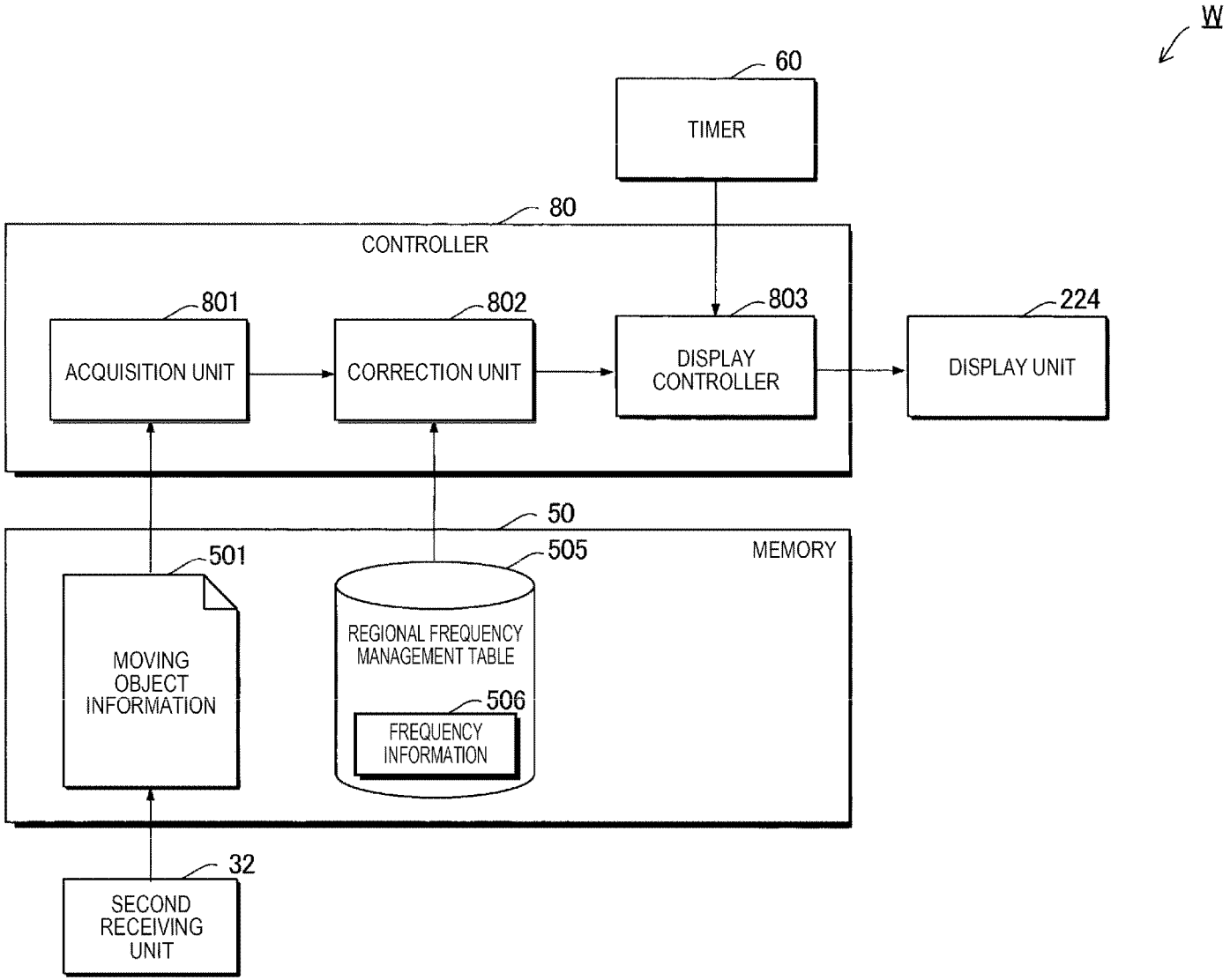
FIG. 12 is a configuration diagram of the controller according to the third embodiment.

FIG. 12 is a configuration diagram of the controller 80. The controller 80 functions as the acquisition unit 801, the correction unit 802, and the display controller 803 by reading and executing a program stored in the memory 50. The functions of the controller 80 in a normal state are the same as those in the first embodiment, and thus descriptions thereof will be omitted.

C.2.1. Controller 80 when User Moves Across Time Zone

The second receiving unit 32 is configured to receive a second specific signal. The moving object information 501 includes a frequency of a carrier wave of the second specific signal received by the second receiving unit 32. The memory 50 stores a regional frequency management table 505. The regional frequency management table 505 includes frequency information 506.

Figures 13, 14:
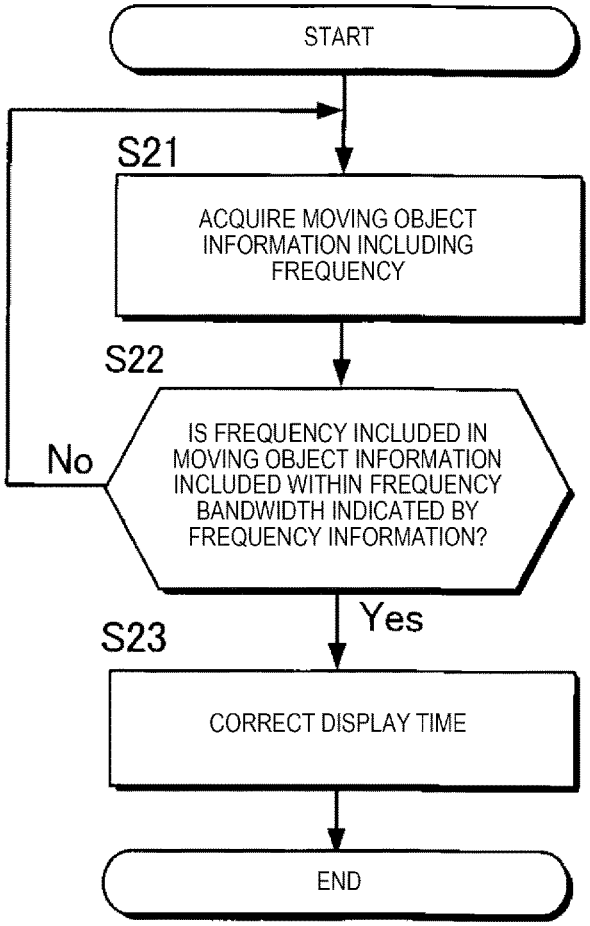
FIG. 13 is a table illustrating an example of stored contents of a regional frequency management table.
FIG. 14 is a flowchart illustrating an operation of the wearable device according to the third embodiment.

FIG. 13 illustrates an example of stored contents of the regional frequency management table 505. The regional frequency management table 505 includes frequency bandwidths for each country or each region, each of which is obtained by the frequency of the carrier wave of the second specific signal transmitted from a country or a region. The regional frequency management table 505 illustrated in FIG. 13 is an example when the second specific signal is a signal based on LoRaWAN. For example, as illustrated in the regional frequency management table 505 of FIG. 13, the frequency bandwidth of 920 MHz to 925 MHz is used in Japan, the frequency bandwidth of 902 MHz to 928 MHz is used in North America, and the frequency bandwidth of 867 MHz to 869 MHz is used in Europe.

In the regional frequency management table 505, the frequency bandwidth obtained by the frequency of the carrier wave of the second specific signal transmitted from the destination place corresponds to the frequency information 506. In FIG. 13, an example when the destination place is included in North America, is illustrated. In this example, the frequency bandwidth of 902 MHz to 928 MHz corresponds to the frequency information 506.

Returning to the description of FIG. 12, the correction unit 802 determines that the predetermined condition is satisfied when the frequency included in the moving object information 501 is included within the frequency bandwidth obtained by the frequency of the carrier wave of the second specific signal transmitted from the destination place, by referring to the frequency information 506. The second specific signal is transmitted in an airport, and thus the second receiving unit 32 receives the second specific signal when the user gets off the airplane AP and is in the airport. Therefore, the predetermined condition according to the third embodiment is a condition for determining whether the airplane AP arrived at the destination place. Which frequency bandwidth in the regional frequency management table 505 is the frequency information 506, that is, where the destination place is, is set in advance, for example, by the user.

C.3. Operation According to Third Embodiment

An operation of the wearable device W when the user moves across a time zone will be described with reference to a flowchart illustrated in FIG. 14.

FIG. 14 is a flowchart illustrating an operation of the wearable device W. In step S21, the acquisition unit 801 acquires the moving object information 501 including the frequency of the carrier wave of the second specific signal received by the second receiving unit 32. In step S22, the correction unit 802 determines whether or not the frequency included in the moving object information 501 is included within the frequency bandwidth indicated by the frequency information 506. When a result of the determination in step S22 is No, that is, when the frequency included in the moving object information 501 is not included within the frequency bandwidth indicated by the frequency information 506, the correction unit 802 returns to the processing of step S21. On the other hand, when the result of the determination in step S22 is Yes, that is, when the frequency included in the moving object information 501 is included within the frequency bandwidth indicated by the frequency information 506, in step S23, the correction unit 802 corrects the display time to the destination-place time based on the time differential factor of the destination place. After the processing of step S23 is ended, the wearable device W ends a series of processing.

C.4. Effects According to Third Embodiment

As described above, in still another aspect, the wearable device W includes a second receiving unit 32 configured to receive a second specific signal whose frequency bandwidth obtained by a frequency of a carrier wave is different for each region, and a memory 50 that stores frequency information 506 indicating a frequency bandwidth obtained by a frequency of a carrier wave of a second specific signal transmitted from a destination place. The moving object information 501 includes the frequency of the carrier wave of the second specific signal received by the second receiving unit 32. The correction unit 802 determines that the predetermined condition is satisfied when the frequency included in the moving object information 501 is included within the frequency bandwidth obtained by the frequency of the carrier wave of the second specific signal transmitted from the destination place, by referring to the frequency information 506.

The second specific signal is transmitted in an airport, and thus the second receiving unit 32 receives the second specific signal when the user gets off the airplane AP and is in the airport. Therefore, according to the aspect, it is possible to correct the display time at an appropriate timing at which the airplane AP arrives at the destination place and the user is in the airport.

D. Fourth Embodiment

As described above, in an indoor space, it is difficult to receive a satellite signal from a GPS satellite. On the other hand, when the user is seated on a window seat in the airplane AP, a satellite signal from a GPS satellite may be received. Therefore, in a fourth embodiment, the timing of correcting the display time is set to a timing at which the time differential factor of a current position specified by a radio wave from a GPS satellite matches with the time differential factor of the destination place. Hereinafter, the fourth embodiment will be described. In each of embodiments and modification examples to be described, components having the same effects and functions as those in the first embodiment are denoted by the same reference numerals used in the first embodiment, and detailed descriptions thereof will be appropriately omitted.

D.1. Outline of Wearable Device W According to Fourth Embodiment

Figure 15:
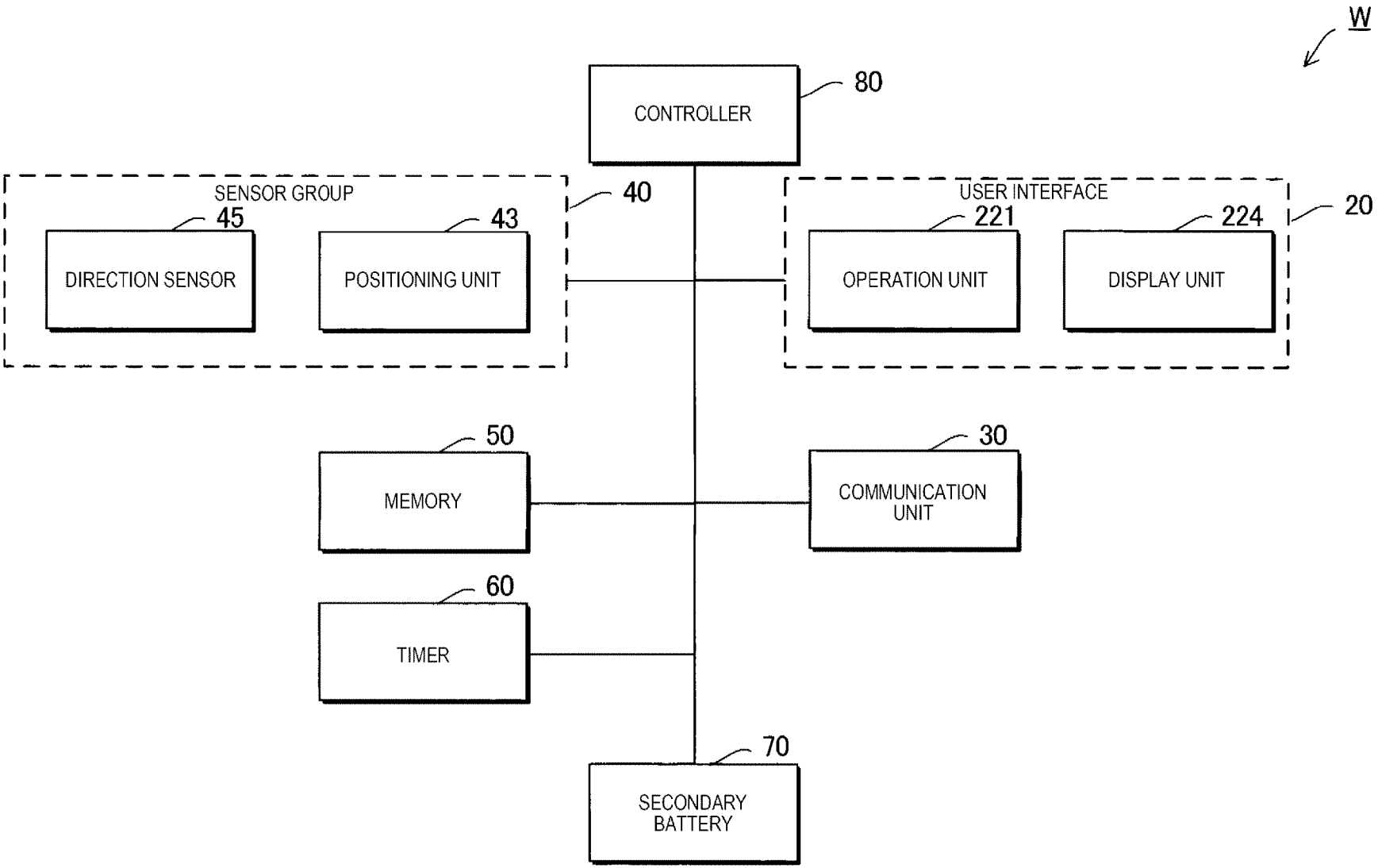
FIG. 15 is a configuration diagram of the wearable device according to a fourth embodiment.

FIG. 15 is a configuration diagram of the wearable device W according to a fourth embodiment. In order to simplify descriptions, it is assumed that the following components correspond to components according to the fourth embodiment unless otherwise stated. The sensor group 40 includes a positioning unit 43.

The positioning unit 43 specifies a current position based on a satellite signal transmitted from a position information satellite such as a GPS satellite. The positioning unit 43 includes an antenna that receives a radio wave from the position information satellite and a specifying circuit that specifies a current position, a current year-month-day, and current time based on an output signal of the antenna.

D.2. Controller 80 According to Fourth Embodiment

Figure 16:
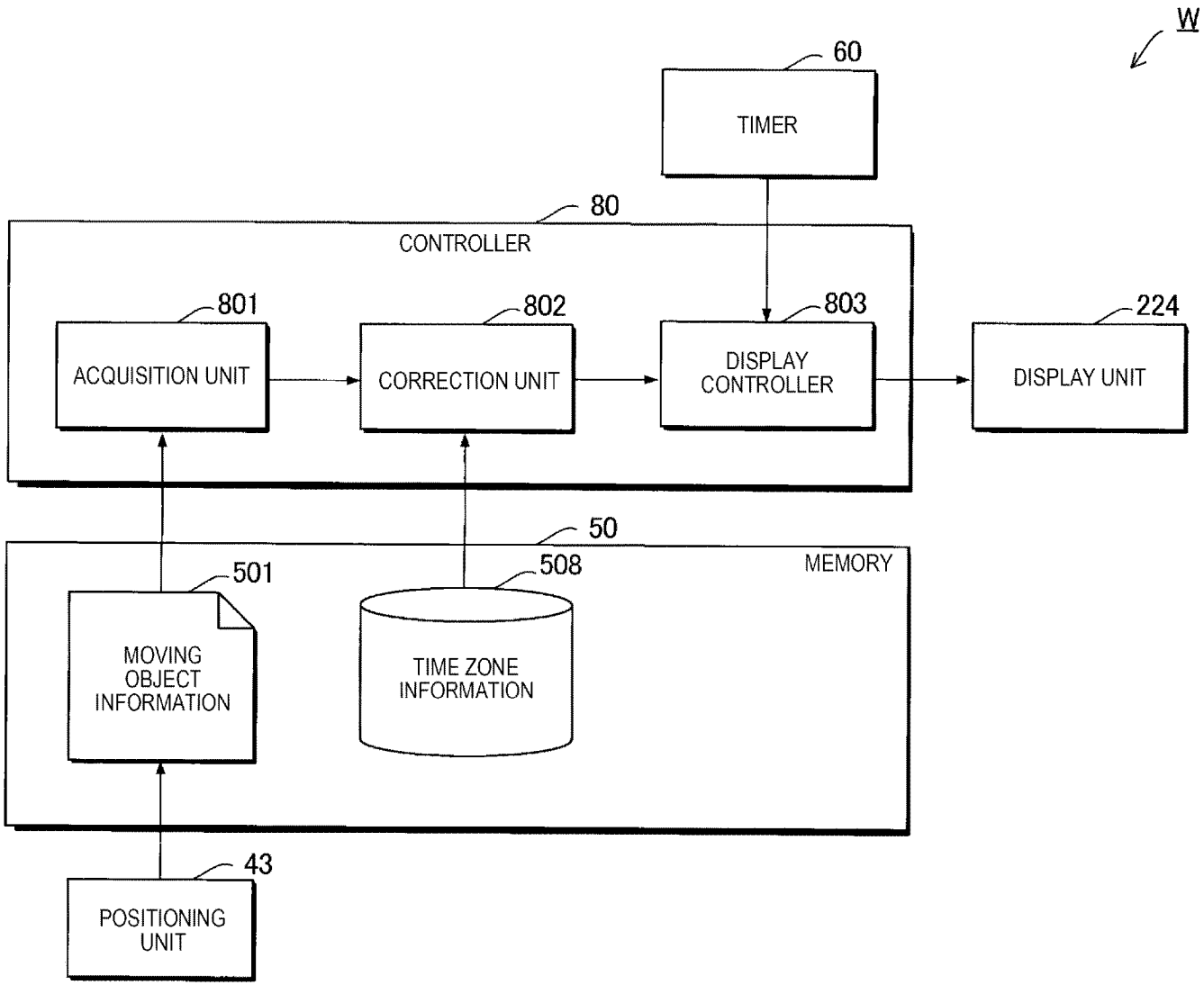
FIG. 16 is a configuration diagram of the controller according to the fourth embodiment.

FIG. 16 is a configuration diagram of the controller 80. The controller 80 functions as the acquisition unit 801, the correction unit 802, and the display controller 803 by reading and executing a program stored in the memory 50. The functions of the controller 80 in a normal state are the same as those in the first embodiment, and thus descriptions thereof will be omitted.

D.2.1. Controller 80 when User Moves Across Time Zone

The memory 50 stores time zone information 508. The time zone information 508 indicates a relationship between a position and a time difference with respect to standard time, that is, a time differential factor. More specifically, the time zone information 508 indicates a time differential factor at each position around the world. For example, the time zone information 508 indicates that a time differential factor is +9:00 at a position in Japan.

The moving object information 501 includes a current position specified by the positioning unit 43.

The correction unit 802 specifies a time differential factor of the current position included in the moving object information 501, by referring to the time zone information 508. Next, the correction unit 802 determines that the predetermined condition is satisfied when the specified time differential factor of the current position matches with the time differential factor of the destination place. As described above, when the user is seated on a window seat in the airplane AP, a satellite signal may be received, and at this time, the airplane AP does not yet arrive at the destination place. Therefore, the predetermined condition according to the fourth embodiment is a condition for determining whether the airplane AP will arrive soon at the destination place.

D.3. Operation According to Fourth Embodiment

An operation of the wearable device W when the user moves across a time zone will be described with reference to a flowchart illustrated in FIG. 17.

Figure 17:
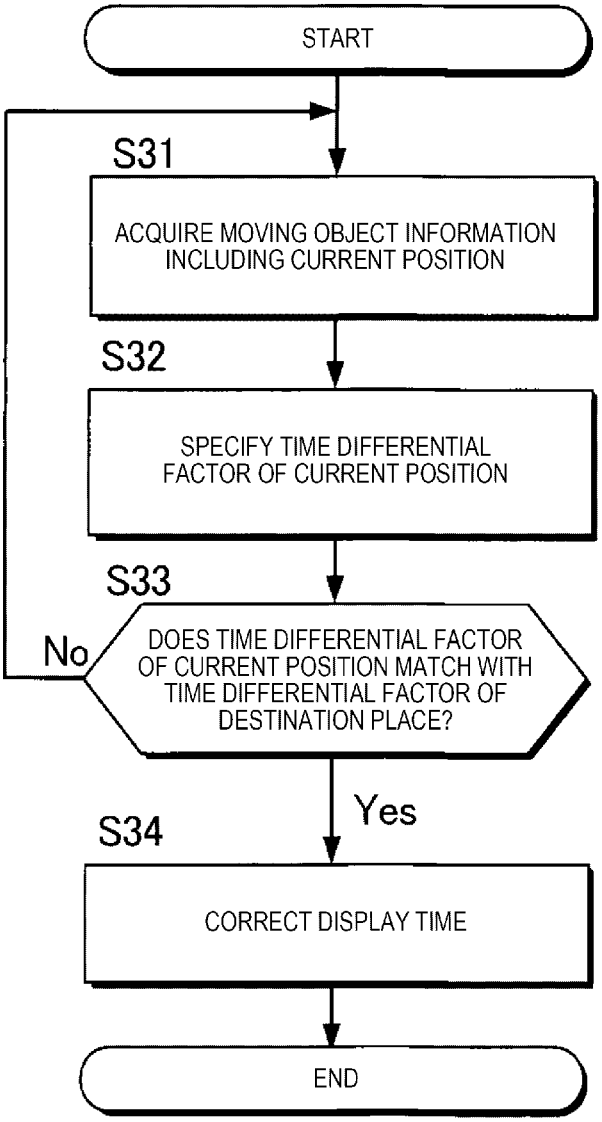
FIG. 17 is a flowchart illustrating an operation of the wearable device according to the fourth embodiment.

FIG. 17 is a flowchart illustrating an operation of the wearable device W. In step S31, the acquisition unit 801 acquires the moving object information 501 including the current position specified by the positioning unit 43. In step S32, the correction unit 802 specifies the time differential factor of the current position included in the moving object information 501, by referring to the time zone information 508. Next, in step S33, the correction unit 802 determines whether or not the time differential factor of the current position matches with the time differential factor of the destination place. When a result of the determination in step S33 is No, that is, when the time differential factor of the current position does not match with the time differential factor of the destination place, the process returns to step S31.

On the other hand, when the result of the determination in step S33 is Yes, that is, when the time differential factor of the current position matches with the time differential factor of the destination place, in step S34, the correction unit 802 corrects the display time to the destination-place time based on the time differential factor of the destination place. After the processing of step S34 is ended, the wearable device W ends a series of processing.

D.4. Effects According to Fourth Embodiment

As described above, in still another aspect, the wearable device W includes a positioning unit 43 that specifies a current position based on a satellite signal transmitted from a position information satellite and a memory 50 that stores time zone information 508 indicating a relationship between a position and a time difference with respect to standard time. The moving object information 501 includes the current position specified by the positioning unit 43. The correction unit 802 specifies a time difference of the current position with respect to the standard time by referring to the time zone information 508, and determines that the predetermined condition is satisfied when the specified time difference matches with the time difference of the destination place.

When a satellite signal may be received and the time differential factor of the current position matches with the time differential factor of the destination place, it is considered that the airplane AP is approaching the destination place and the airplane AP will arrive soon at the destination place. Therefore, according to the aspect, it is possible to correct the display time at an appropriate timing at which the airplane AP will arrive soon at the destination place.

E. Fifth Embodiment

In a fifth embodiment, the timing of correcting the display time is set to a timing at which the display time reaches time that is earlier than destination-place arrival time of the airplane AP by a predetermined time. Hereinafter, the fifth embodiment will be described. In each of embodiments and modification examples to be described, components having the same effects and functions as those in the first embodiment are denoted by the same reference numerals used in the first embodiment, and detailed descriptions thereof will be appropriately omitted.

E.1. Outline of Wearable Device W According to Fifth Embodiment

Figure 18:
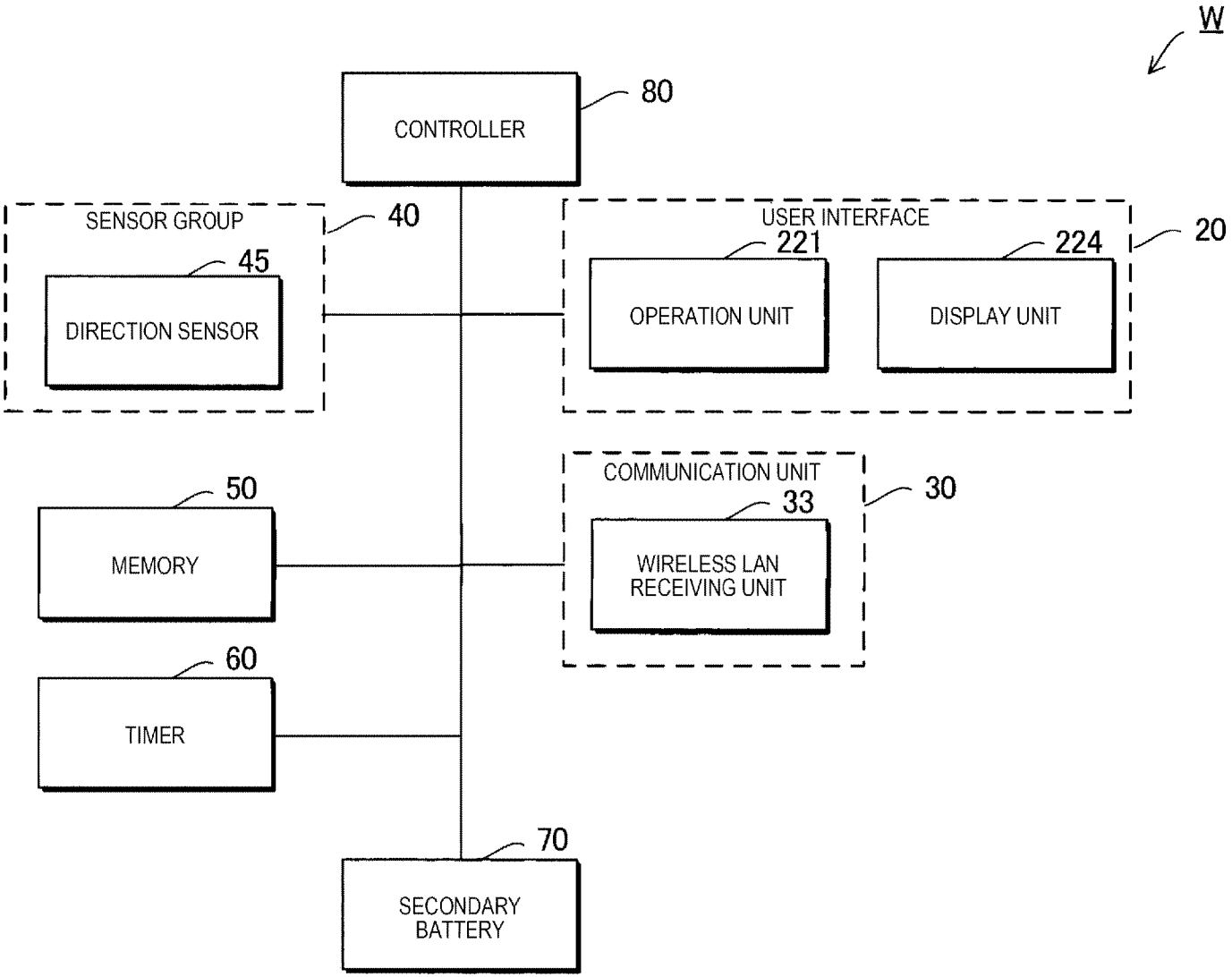
FIG. 18 is a configuration diagram of the wearable device according to a fifth embodiment.

FIG. 18 is a configuration diagram of the wearable device W according to a fifth embodiment. In order to simplify descriptions, it is assumed that the following components correspond to components according to the fifth embodiment unless otherwise stated. The communication unit 30 includes a wireless LAN receiving unit 33.

The wireless LAN receiving unit 33 receives in-flight service information 504 provided for passengers or crew members in the airplane AP.

FIG. 19 illustrates an example of the in-flight service information 504. The in-flight service information 504 includes a GPS position, current time, estimated arrival time, a delay time, a destination-place name, destination-place time, an altitude, and in-flight service data.

The GPS position indicates a current position of the airplane AP specified by a GPS module of the airplane AP. The current time indicates current time at the GPS position. The estimated arrival time is estimated time at which the airplane AP arrives at the destination place. The delay time is a time delayed from the estimated arrival time when the airplane AP is delayed. As illustrated in FIG. 19, when the delay time is "–", this indicates that the airplane AP is not delayed, and when the delay time is a specific time, this indicates that the airplane AP is delayed and the delay time is the specific time. The destination-place name is a name of an airport as the destination place of the airplane AP. The destination-place time indicates a current time of the airport as the destination place. The altitude indicates an altitude of the airplane AP. The in-flight service data is entertainment information such as information on movies being played in the airplane AP.

E.2. Controller 80 According to Fifth Embodiment

Figure 20:
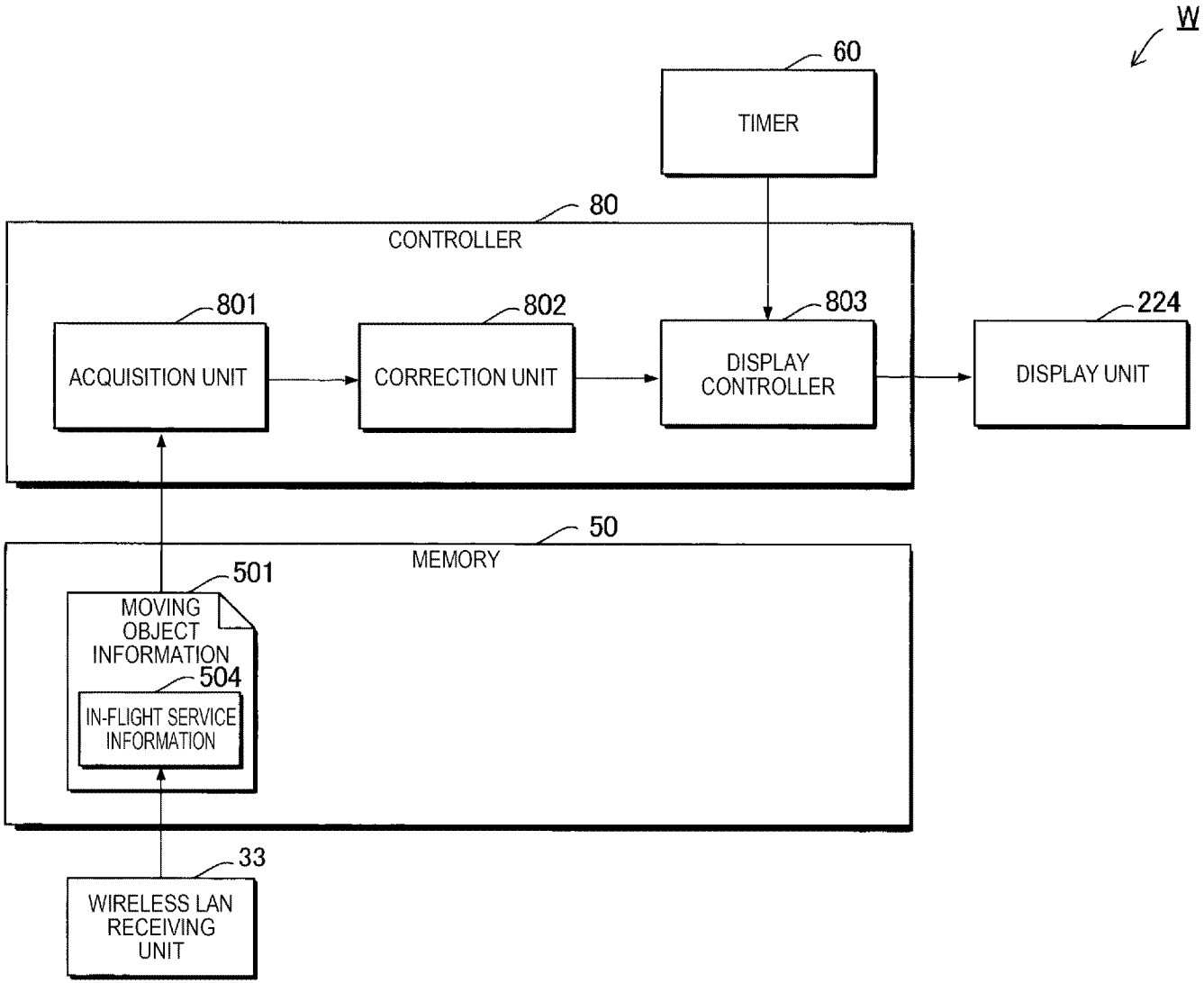
FIG. 20 is a configuration diagram of the controller according to the fifth embodiment.

FIG. 20 is a configuration diagram of the controller 80. The controller 80 functions as the acquisition unit 801, the correction unit 802, and the display controller 803 by reading and executing a program stored in the memory 50. The functions of the controller 80 in a normal state are the same as those in the first embodiment, and thus descriptions thereof will be omitted.

E.2.1. Controller 80 when User Moves Across Time Zone

The moving object information 501 includes the in-flight service information 504. The in-flight service information 504 includes the estimated arrival time.

The correction unit 802 determines that the predetermined condition is satisfied when the display time reaches time that is earlier than the estimated arrival time by a predetermined time. The predetermined time is set in advance by the user. The airplane AP does not yet arrive at the destination place, and thus, in this case, the predetermined condition is a condition for determining whether the airplane AP will arrive soon at the destination place.

When the delay time is included in the in-flight service information 504, the correction unit 802 determines that the predetermined condition is satisfied when the display time reaches time obtained by adding the delay time to the estimated arrival time. Even in this case, the airplane AP is delayed and does not yet arrive at the destination place. Thus, in this case, the predetermined condition is a condition for determining whether the airplane AP will arrive soon at the destination place.

An example in which the delay time is reflected to the estimated arrival time and the in-flight service information 504 is distributed, is also considered. In this case, the correction unit 802 determines whether or not the display time reaches time that is earlier than the estimated arrival time by the predetermined time, without identifying the delay time.

E.3. Operation According to Fifth Embodiment

An operation of the wearable device W when the user moves across a time zone will be described with reference to a flowchart illustrated in FIG. 21.

Figure 21:
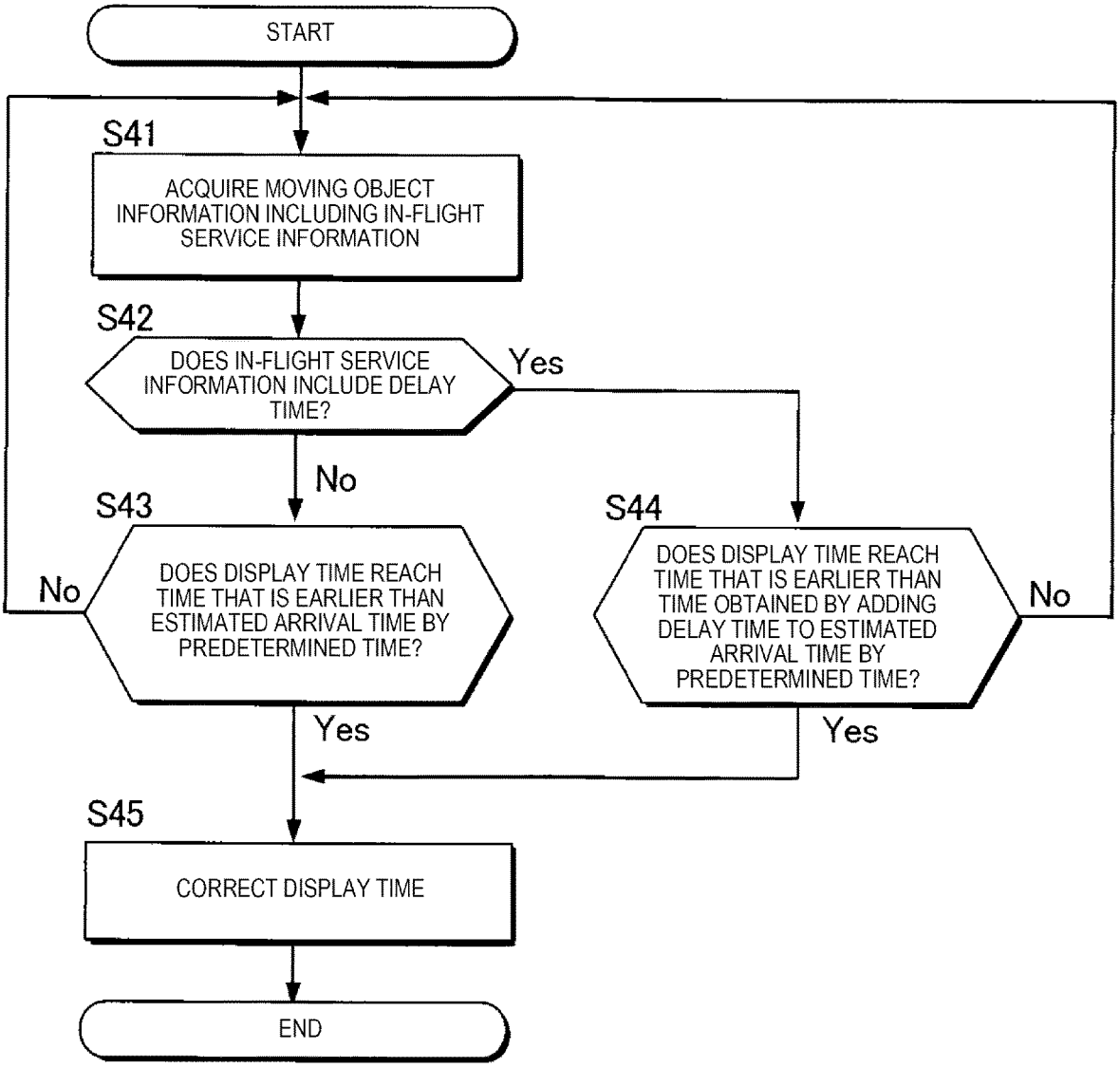
FIG. 21 is a flowchart illustrating an operation of the wearable device according to the fifth embodiment.

FIG. 21 is a flowchart illustrating an operation of the wearable device W. In step S41, the acquisition unit 801 acquires the moving object information 501 including the in-flight service information 504. Next, in step S42, the correction unit 802 determines whether or not the in-flight service information 504 includes a delay time. When a result of the determination in step S42 is No, that is, when the in-flight service information 504 does not include a delay time, in step S43, the correction unit 802 determines whether or not the display time reaches time that is earlier than the estimated arrival time by the predetermined time. When a result of the determination in step S43 is No, that is, when the display time does not reach time that is earlier than the estimated arrival time by the predetermined time, the correction unit 802 returns to the processing of step S41.

When the result of the determination in step S42 is Yes, that is, when the in-flight service information 504 includes a delay time, in step S44, the correction unit 802 determines whether or not the display time reaches time that is earlier than time obtained by adding the delay time to the estimated arrival time by the predetermined time. When a result of the determination in step S44 is No, that is, when the display time does not reach time that is earlier than time obtained by adding the delay time to the estimated arrival time by the predetermined time, the correction unit 802 returns to the processing of step S41.

When the result of the determination in step S43 is Yes, that is, when the display time reaches time that is earlier than the estimated arrival time by the predetermined time, in step S45, the correction unit 802 corrects the display time to the destination-place time based on the time differential factor of the destination place. Similarly, when the result of the determination in step S44 is Yes, that is, when the display time reaches time that is earlier than time obtained by adding the delay time to the estimated arrival time by the predetermined time, the correction unit 802 executes the processing of step S45. After the processing of step S45 is ended, the wearable device W ends a series of processing.

E.4. Effects According to Fifth Embodiment

As described above, in still another aspect of the wearable device W, the moving object information 501 includes estimated arrival time at which the moving object is estimated to arrive at the destination place, and the correction unit 802 determines that the predetermined condition is satisfied when the time to be displayed on the display unit 224 reaches time that is earlier than the estimated arrival time by the predetermined time.

According to the aspect, it is possible to correct the display time at an appropriate timing at which the airplane AP will arrive soon and which is earlier than the estimated arrival time by the predetermined time.

Further, in still another aspect of the wearable device W, the moving object information 501 includes estimated arrival time at which the moving object is estimated to arrive at the destination place and a delay time by which the moving object is delayed from the estimated arrival time. The correction unit 802 determines that the predetermined condition is satisfied when the time to be displayed on the display unit 224 reaches time that is earlier than time obtained by adding the delay time to the estimated arrival time by the predetermined time.

According to the aspect, even when the airplane AP is delayed, it is possible to correct the display time at an appropriate timing at which the airplane AP will arrive soon and which is earlier than time obtained by adding the delay time to the estimated arrival time, that is, estimated arrival time in which the delay is considered, by the predetermined time.

F. Sixth Embodiment

In a sixth embodiment, as in the fifth embodiment, the timing of correcting the display time is set to a timing at which the display time reaches time that is earlier than destination-place arrival time of the airplane AP by a predetermined time. On the other hand, the wearable device W calculates estimated arrival time based on a destination place, a current position of the airplane AP, and a moving speed of the airplane AP. The destination place, the current position of the airplane AP, and the moving speed of the airplane AP may be acquired from the aerial radio signal illustrated in the second embodiment. Hereinafter, the sixth embodiment will be described. In each of embodiments and modification examples to be described, components having the same effects and functions as those in the first embodiment are denoted by the same reference numerals used in the first embodiment, and detailed descriptions thereof will be appropriately omitted.

F.1. Outline of Wearable Device W According to Sixth Embodiment

A configuration diagram of the wearable device W according to the sixth embodiment is the same as the configuration diagram of the wearable device W according to the second embodiment, and thus illustration thereof will be omitted. In order to simplify descriptions, it is assumed that the following components correspond to components according to the sixth embodiment unless otherwise stated.

F.2. Controller 80 According to Sixth Embodiment

Figure 22:
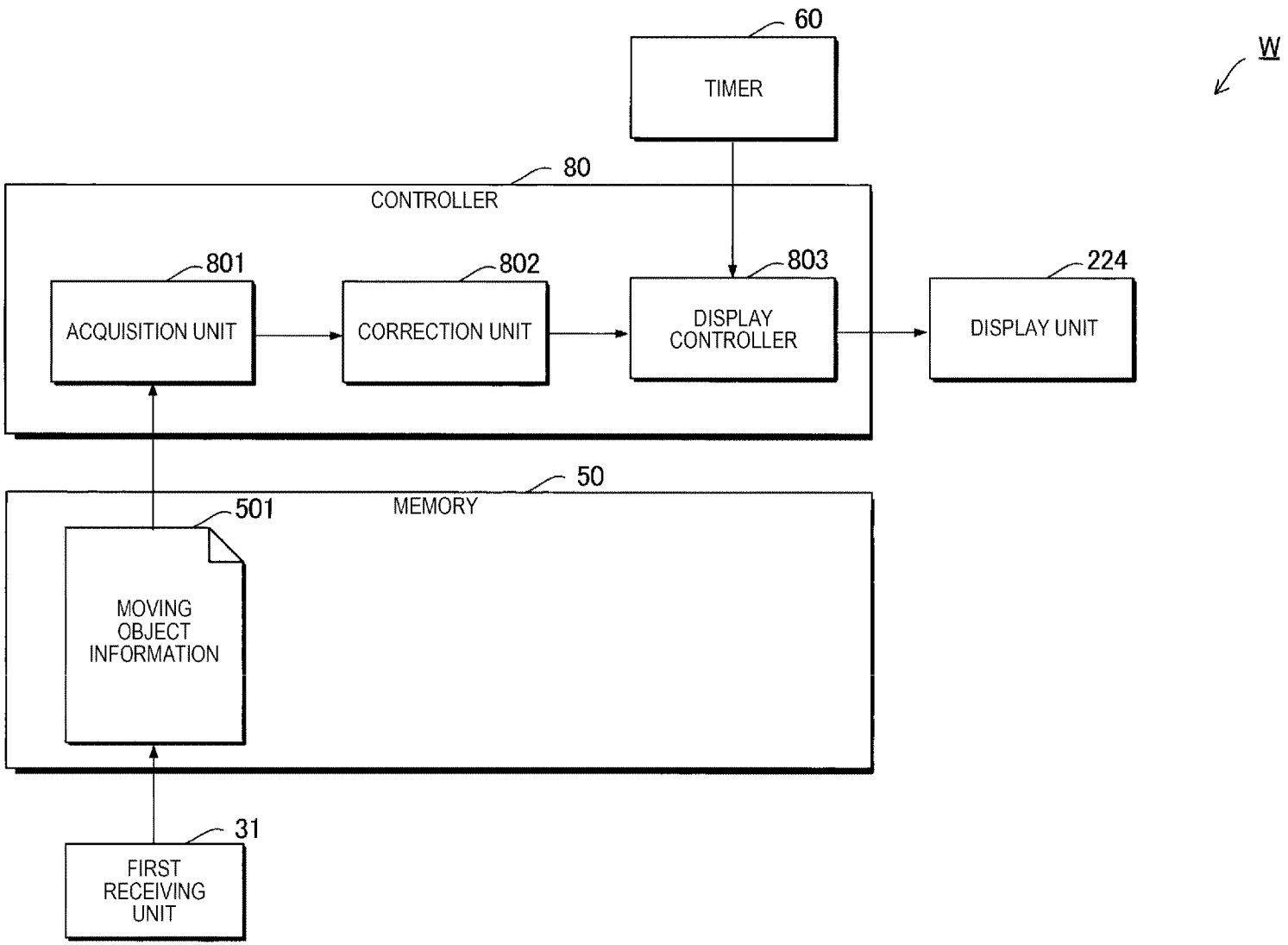
FIG. 22 is a configuration diagram of the controller according to a sixth embodiment.

FIG. 22 is a configuration diagram of the controller 80. The controller 80 functions as the acquisition unit 801, the correction unit 802, and the display controller 803 by reading and executing a program stored in the memory 50. The functions of the controller 80 in a normal state are the same as those in the first embodiment, and thus descriptions thereof will be omitted.

F.2.1. Controller 80 when User Moves Across Time Zone

The first receiving unit 31 acquires a destination place, a current position of the airplane AP, and a moving speed of the airplane AP from the aerial radio signal. The moving object information 501 includes the destination place, the current position of the airplane AP, and the moving speed of the airplane AP.

The correction unit 802 calculates estimated arrival time based on the destination place, the current position of the airplane AP, and the moving speed of the airplane AP. The correction unit 802 determines that the predetermined condition is satisfied when the display time reaches time that is earlier than the estimated arrival time by a predetermined time.

F.3. Operation According to Sixth Embodiment

An operation of the wearable device W when the user moves across a time zone will be described with reference to a flowchart illustrated in FIG. 23.

Figure 23:
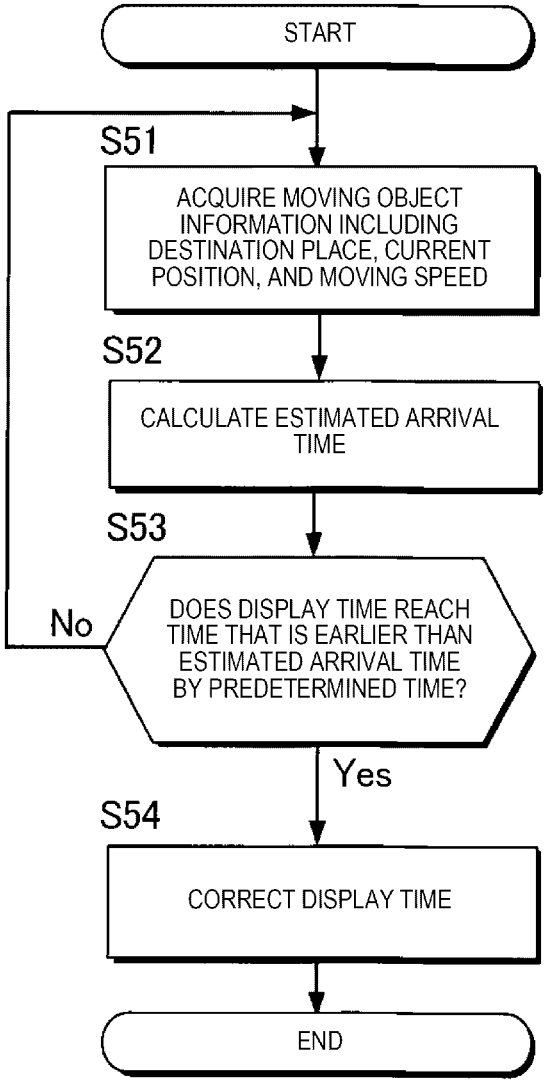
FIG. 23 is a flowchart illustrating an operation of the wearable device according to the sixth embodiment.

FIG. 23 is a flowchart illustrating an operation of the wearable device W. In step S51, the acquisition unit 801 acquires the moving object information 501 including the destination place, the current position of the airplane AP, and the moving speed of the airplane AP. In step S52, the correction unit 802 calculates estimated arrival time based on the destination place, the current position of the airplane AP, and the moving speed of the airplane AP. The correction unit 802 may calculate estimated arrival time using climate information, a trajectory prediction model, or the like, or may simply calculate estimated arrival time using a distance obtained from the destination place and the current position of the airplane AP, and the moving speed of the airplane AP.

In step S53, the correction unit 802 determines whether or not the display time reaches time that is earlier than the estimated arrival time by a predetermined time. When a result of the determination in step S53 is No, that is, when the display time does not reach time that is earlier than the estimated arrival time by the predetermined time, the correction unit 802 returns to the processing of step S51. When the result of the determination in step S53 is Yes, that is, when the display time reaches time that is earlier than the estimated arrival time by the predetermined time, in step S54, the correction unit 802 corrects the display time to the destination-place time based on the time differential factor of the destination place. After the processing of step S54 is ended, the wearable device W ends a series of processing.

F.4. Effects According to Sixth Embodiment

As described above, in still another aspect of the wearable device W, the moving object information 501 includes a destination place, a current position of the moving object, and a moving speed of the moving object. The correction unit 802 calculates estimated arrival time at which the moving object is estimated to arrive at the destination place based on the destination place, the current position of the moving object, and the moving speed of the moving object, and determines that the predetermined condition is satisfied when the time to be displayed on the display unit 224 reaches time that is earlier than the estimated arrival time by the predetermined time.

According to the aspect, even when estimated arrival time is not directly obtained, it is possible to correct the display time at an appropriate timing at which the airplane AP will arrive soon using the estimated arrival time which is calculated.

G. Modification Examples

Each of the embodiments may be variously modified. Hereinafter, specific modification examples will be described. Two or more examples which are randomly selected from the following examples may be appropriately combined with each other within a range in which the examples are compatible with each other. In modification examples to be described, components having the same effects and functions as those in the embodiments are denoted by the same reference numerals used in the above description, and detailed descriptions thereof will be appropriately omitted.

G.1. First Modification Example

As described above, the acceleration-speed altitude according to the first embodiment is obtained by integrating the acceleration speeds from the departure place to the current place in the gravitational direction twice, the acceleration speeds being included in the moving object information 501. On the other hand, errors are included in the acceleration speeds of the acceleration sensor 42, and as a result, when calculating the acceleration-speed altitude by integrating the acceleration speeds, the errors accumulate. Thus, a value of the acceleration-speed altitude may be greatly different from a value of an actual altitude. In this regard, in a first modification example, in order to suppress an influence of the accumulated errors, focusing on a relationship between a change in the acceleration-speed altitude per fixed time and a change in the atmospheric-pressure altitude, it is determined whether or not the predetermined condition is satisfied, that is, whether or not the airplane AP will arrive soon at the destination place. In order to simplify descriptions, it is assumed that the following components correspond to components according to the first modification example unless otherwise stated.

In the first modification example, a correction value C' corresponding to the correction value C of the first embodiment satisfies the following expression (5).

$$h=C'_0d_0+C'(d-d_0) \tag{5}$$

h indicates the atmospheric-pressure altitude at the current time. $d_0$ indicates the acceleration-speed altitude at time that is earlier than the current time by a fixed time. The fixed time may be any time, for example, 5 minutes. $C'_0$ indicates a correction value C' at time that is earlier than the current time by the fixed time, and is a value obtained using $d_0$. d indicates the acceleration-speed altitude at the current time. In expression (5), at a place at which there is no acceleration-speed altitude at time that is earlier than the current time by the fixed time, that is, at the departure place, the correction value C' is calculated by h=C'd. In addition, in expression (5), when $d=d_0$, $h=C'_0d_0$ is obtained. In this case, even when C' becomes indefinite and C' has any value, expression (5) is satisfied. On the other hand, when $d=d_0$, it is assumed that $C'=C'_0$.

The correction unit 802 determines that the predetermined condition is satisfied when the airplane AP is descending and the correction value C' obtained by using expression (5) is equal to or larger than the predetermined value A'. The predetermined value A' is a value larger than 0 and equal to or smaller than 1, and may be a value close to 1.

In order to explain effects according to the first modification example, expression (5) is modified into the following expression (6).

$$C'=(h-C'_0d_0)/(d-d_0) \tag{6}$$

It is regarded that a numerator on a right-hand side of expression (6) indicates a change amount in the atmospheric-pressure altitude per fixed time. Similarly, it is regarded that a denominator on the right-hand side of expression (6) indicates a change amount in the acceleration-speed altitude per fixed time. Thus, the correction value C' is a ratio value between the change amount of the atmospheric-pressure altitude per fixed time and the change amount of the acceleration-speed altitude per fixed time. When the airplane AP turns from horizontal flight to landing, the change amount of the acceleration-speed altitude per fixed time becomes larger than the change amount of the atmospheric-pressure altitude per fixed time, and the correction value C' becomes smaller than 1. On the other hand, immediately before the airplane AP lands, the change amount of the acceleration-speed altitude per fixed time is almost the same as the change amount of the atmospheric-pressure altitude per fixed time, and the correction value C' becomes very close to 1. The first modification example focuses on the change amount of the atmospheric-pressure altitude per fixed time and the change amount of the acceleration-speed altitude per fixed time, and thus, an altitude difference between the departure place and the destination place is unnecessary. Therefore, the correction unit 802 may determine that the airplane AP arrives at the destination place with high accuracy even when the altitude difference between the departure place and the destination place is not known in advance. Further, the correction unit 802 uses the change amount of the acceleration-speed altitude per fixed time, and thus accumulation of errors is suppressed. Therefore, it is possible to determine that the airplane AP arrives at the destination place with higher accuracy than in the first embodiment.

In the first modification example, the moving object information 501 may include a change amount of the atmospheric pressure per fixed time measured by the atmospheric pressure sensor 41, and a change amount of the acceleration speed per fixed time measured by the acceleration sensor 42.

G.2. Other Modification Examples

In the first embodiment, although it is determined that the predetermined condition is satisfied when the airplane AP is descending and the correction value C is equal to or larger than the predetermined value A, the present disclosure is not limited thereto. For example, since the correction value C is obtained by atmospheric-pressure altitude/acceleration-speed altitude, the correction unit 802 may determine that the predetermined condition is satisfied when acceleration-speed altitude/atmospheric-pressure altitude, which is the reciprocal of the correction value C, is equal to or smaller than a predetermined value B. The predetermined value B is a real number equal to or larger than 1, and may be a value close to 1.

In each of the embodiments, when two or more of the predetermined condition according to the first embodiment, the predetermined condition according to the second embodiment, the predetermined condition according to the third embodiment, the predetermined condition according to the fourth embodiment, the predetermined condition according to the fifth embodiment, and the predetermined condition according to the sixth embodiment are satisfied, the display time may be corrected. For example, although the predetermined condition according to the fourth embodiment is satisfied when the time differential factor of the current position matches with the time differential factor of the destination place, a movement by the airplane AP may be a movement in the same time zone. For example, when the airplane AP moves from Tokyo to an eastern part of Indonesia, the time differential factor of Tokyo and the time differential factor of the eastern part of Indonesia are +9:00, and as a result, in the predetermined condition according to the fourth embodiment, at a timing at which the airplane AP is in the departure place, it is regarded that the airplane AP will arrive soon at the destination place. Therefore, the correction unit 802 may correct the display time when the predetermined condition according to the fourth embodiment and the predetermined condition according to another embodiment are satisfied.

Although the acquisition unit 801 according to the first embodiment acquires the time differential factor of the destination place, for example, from an input operation by the user or from an external computer via the communication unit 30, the present disclosure is not limited thereto. For example, the wearable device W may include an image capturing unit. In this case, the image capturing unit may capture an image of an airplane ticket or a boarding pass of the airplane AP, and acquire the time differential factor of the destination place from the captured image. Further, when the estimated arrival time of the destination place is described on the airplane ticket or the boarding pass of the airplane AP, the acquisition unit 801 may acquire the estimated arrival time of the destination place from the captured image.

In the first embodiment, whether or not the airplane AP is descending is determined by the sign of the speed obtained by integrating the acceleration speeds of the moving object information 501 in the gravitational direction. On the other hand, the present disclosure is not limited thereto. For example, the correction unit 802 may determine that the airplane AP is descending when the correction value C is increasing. Alternatively, in a case where atmospheric pressure from the departure place to the current place is included in the moving object information 501, the correction unit 802 may determine that the airplane AP is descending when the atmospheric pressure is increasing.

In the second embodiment, the first receiving unit 31 may receive an aerial radio signal transmitted by an airplane AP other than the airplane AP on which the user is on board, in addition to the aerial radio signal transmitted by the airplane AP on which the user is on board. The aerial radio signal includes a flight number of the airplane AP. Therefore, the wearable device W may display the flight number of the received aerial radio signal on the display unit 224, and allow the user to select whether or not the displayed flight name is a flight number of the airplane AP on which the user is on board. The wearable device W allows selection of the user, and thus it is possible to prevent the wearable device W from determining that it is time to correct the display time based on the aerial radio signal transmitted by an airplane AP other than the airplane AP on which the user is on board.

In the second embodiment, the first receiving unit 31 receives an aerial radio signal. On the other hand, the present disclosure may also be applied to a moving object other than an airplane AP. For example, a ship transmits a ship signal. Therefore, when the moving object is a ship, the first receiving unit 31 receives the ship signal.

The positioning unit 43 according to the fourth embodiment may receive satellite signals from positioning satellites of GNSS or positioning satellites other than GNSS. For example, the positioning unit 43 may receive satellite signals from satellites of one satellite positioning system or two or more satellite positioning systems, among satellite positioning systems such as wide area augmentation system (WAAS), European geostationary-satellite navigation overlay service (EGNOS), quasi zenith satellite system (QZSS), global navigation satellite system (GLONASS), GALILEO, and BeiDou navigation satellite system (BeiDou).

In the third embodiment, the wearable device W includes the second receiving unit 32. On the other hand, in any one embodiment of the first embodiment, the second embodiment, the fourth embodiment, the fifth embodiment, and the sixth embodiment, the second receiving unit 32 may be included. When the predetermined condition according to any one of the embodiments is satisfied, the wearable device W may correct the display time, and the second receiving unit 32 may be set to receive the frequency bandwidth obtained by the frequency of the carrier wave of the second specific signal transmitted from the destination place.

In each of the embodiments, the wearable device W may include a radio wave timepiece module configured to receive a standard radio wave. Even in a case where the wearable device W includes a radio wave timepiece module, the wearable device W does not use the radio wave timepiece module for processing of correcting the display time when the user moves across a time zone. Therefore, the wearable device W may reduce power consumption.

As described above, the wearable device W may include the positioning unit 43 or the radio wave timepiece module. In this case, when the wearable device W is located in an indoor space such as an airport, the time correction according to each of the embodiments is performed, and when the wearable device W is located outdoors, the time correction may be performed by the positioning unit 43 or the radio wave timepiece module. In the time correction according to each of the embodiments, when the display time is shifted from the departure-place time, the display time is corrected to the destination-place time while including time shift. Therefore, when the wearable device W is located outdoors, the time correction is performed by the positioning unit 43 or the radio wave timepiece module, and thus, it is possible to correct the time shift.

In each of the aspects, the correction unit 802 corrects the display time based on the date-and-time generated by the timer 60 and the time differential factor of the destination place. On the other hand, the present disclosure is not limited thereto. For example, the correction unit 802 may correct the date-and-time itself generated by the timer 60 based on the time differential factor of the destination place, and the display unit 224 may correct the corrected date-and-time.

In each of the aspects, the wearable device W may be regarded as a computer program configured to function as each part of the wearable device W or a computer-readable recording medium in which the computer program is recorded. The recording medium is, for example, a non-transitory recording medium, and may include any known recording medium such as a semiconductor recording medium and a magnetic recording medium, in addition to an optical recording medium such as a CD-ROM. The wearable device W may be specified as a time correction method according to each of the aspects.

In each of the aspects, although the wearable device W is a digital watch, the wearable device W may be an analog watch including the communication unit 30, the controller 80, and the like, or may be a combination quartz (CQ). When the wearable device W is an analog watch, the display unit 224 includes pointers for displaying time.

What is claimed is:

1. A wearable device comprising:

a display that displays time;

an atmospheric pressure sensor;

an acceleration sensor; and a processor that acquires moving object information related to a moving object which moves to a destination place and a time difference of the destination place with respect to standard time, and corrects the time to be displayed on the display unit based on the time difference when it is determined that a predetermined condition related to arrival of the moving object to the destination place is satisfied based on the moving object information, wherein the moving object information includes departure-place atmospheric pressure and current-place atmospheric pressure that are measured by the atmospheric pressure sensor, and an acceleration speed from a departure place to a current place that is measured by the acceleration sensor, and wherein the processor determines that the predetermined condition is satisfied when it is specified that the moving object is descending based on the acceleration speed of the moving object information, and when a ratio value between an altitude specified based on the atmospheric pressure of the moving object information and an altitude specified based on the acceleration speed of the moving object information is equal to or larger than a predetermined value.

2. The wearable device according to claim 1, further comprising:

a first receiver configured to receive a first specific signal transmitted from the moving object, wherein the first receiver generates determination information indicating whether or not the moving object is transmitting the first specific signal, wherein the moving object information includes the determination information, and wherein the processor determines that the predetermined condition is satisfied when the determination information included in the moving object information indicates that the moving object does not transmit the first specific signal.

3. The wearable device according to claim 1, further comprising:

a second receiver configured to receive a second specific signal whose frequency bandwidth obtained by a frequency of a carrier wave is different for each region; and a memory that stores frequency information indicating the frequency bandwidth obtained by the frequency of the carrier wave of the second specific signal transmitted from the destination place, wherein the moving object information includes the frequency of the carrier wave of the second specific signal received by the second receiver, and wherein the processor determines that the predetermined condition is satisfied when the frequency included in the moving object information is included within the frequency bandwidth obtained by the frequency of the carrier wave of the second specific signal transmitted from the destination place, by referring to the frequency information.

4. The wearable device according to claim 1, wherein the moving object information includes an estimated arrival time at which the moving object is estimated to arrive at the destination place, and wherein the processor determines that the predetermined condition is satisfied when the time to be displayed on the display unit reaches time that is earlier than the estimated arrival time by a predetermined time.

5. The wearable device according to claim 1, wherein the moving object information includes an estimated arrival time at which the moving object is estimated to arrive at the destination place and a delay time by which the moving object is delayed from the estimated arrival time, and wherein the processor determines that the predetermined condition is satisfied when the time to be displayed on the display unit reaches time that is earlier than time obtained by adding the delay time to the estimated arrival time by a predetermined time.

6. The wearable device according to claim 1, wherein the moving object information includes the destination place, a current position of the moving object, and a moving speed of the moving object, and wherein the processor calculates an estimated arrival time at which the moving object is estimated to arrive at the destination place based on the destination place, the current position of the moving object, and the moving speed of the moving object, and determines that the predetermined condition is satisfied when the time to be displayed on the display unit reaches time that is earlier than the estimated arrival time by a predetermined time.

7. A time correction method of a wearable device including a display that displays time and a processor, the method causing the processor to:

acquire moving object information related to a moving object which moves to a destination place and a time difference of the destination place with respect to standard time; and correct the time to be displayed on the display unit based on the time difference when it is determined that a predetermined condition related to arrival of the moving object to the destination place is satisfied based on the moving object information, wherein the moving object information includes departure-place atmospheric pressure and current-place atmospheric pressure measured by an atmospheric pressure sensor, and an acceleration speed from a departure place to a current place measured by an acceleration sensor, and wherein the processor is caused to determine that the predetermined condition is satisfied when it is specified that the moving object is descending based on the acceleration speed of the moving object information, and when a ratio value between an altitude specified based on the atmospheric pressure of the moving object information and an altitude specified based on the acceleration speed of the moving object information is equal to or larger than a predetermined value.

* * * * *